US006419381B2

(12) United States Patent
Nino et al.

(10) Patent No.: US 6,419,381 B2
(45) Date of Patent: Jul. 16, 2002

(54) VEHICLE HEAD LAMP AND METHOD OF FORMING A REFLECTING MIRROR THEREFOR

(75) Inventors: Naohi Nino; Shinji Kagiyama; Takeshi Arai, all of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/732,702

(22) Filed: Dec. 11, 2000

(30) Foreign Application Priority Data

Dec. 9, 1999 (JP) ..... 11-350095

(51) Int. Cl.[7] ..... F21V 7/00

(52) U.S. Cl. ..... 362/518; 362/346; 362/348; 362/350

(58) Field of Search ..... 362/517, 518, 362/346, 348, 350

(56) References Cited

U.S. PATENT DOCUMENTS 5,192,124 A * 3/1993 Kawashima et al. ..... 362/61
5,258,897 A 11/1993 Nino ..... 362/346
5,390,097 A 2/1995 Nino ..... 362/346
5,418,695 A * 5/1995 Yoshida ..... 362/61
5,519,589 A 5/1996 Nino ..... 362/61
5,645,339 A 7/1997 Tatsukawa ..... 362/61
5,876,114 A 3/1999 Nino ..... 362/518

* cited by examiner

*Primary Examiner*—Sandra O'Shea
*Assistant Examiner*—Ali Alavi
(74) *Attorney, Agent, or Firm*—Sughrue Mion, PLLC

(57) ABSTRACT

A reflecting mirror, for a vehicle headlamp, which provides a sufficient amount of light near a slant cutoff line in downward-beam light distribution, thereby improving visibility in a long-distance region and a medium-distance region. The reflecting mirror has at least a first reflecting area and a second reflecting area. For a first reflecting area (10B—close to a horizontal reference face (x-y plane) when a reflecting face (10) is viewed from an optical axis direction—a reference curve is set in a slant reference face inclined to the horizontal reference face at an angle equal to an angle (θcol) of a slant cutoff line with a horizontal line. For a second reflecting area (10D, 10E)—positioned above or below the first reflecting area (10B) with respect to the horizontal reference face—a reference curve is set in a slant reference face inclined to the horizontal reference face at a second angle larger than 0° and smaller than the angle of the slant cutoff line with the horizontal line. Parabolas are then associated with planes orthogonal to the slant reference face, thereby forming a curved surface.

12 Claims, 19 Drawing Sheets

VEHICLE HEAD LAMP AND METHOD OF FORMING A REFLECTING MIRROR THEREFOR

BACKGROUND OF THE INVENTION

1. Technical Field of the Invention

This invention relates to methods of forming a reflecting mirror and a reflecting face, for a vehicle head lamp, to provide a downward-beam light distribution.

2. Related Art

In a basic configuration, a vehicle head lamp includes a reflecting mirror shaped like a paraboloid of revolution and a front lens having a diffusing lens ahead the reflecting mirror. Recently, the light distribution control function has been at least partially shifted from the front lens to the reflecting mirror so that the front lens can be slanted so as to match the shape of a particular vehicle. That is, the lens is slantedlargely in a vertical plane to match the shape of a front end of a car body and, thereby, provide a lamp shape suitable for the vehicle shape. However, to maintain a suitable light distribution as required for each car model, the full face of a reflector is used effectively, whereby a light distribution pattern having a cutoff line peculiar to a downward beam can be formed is proposed; for example, a lamp disclosed in U.S. Pat. No. 5,258,897, etc., is known.

That is, in this kind of lamp, the front lens becomes plain, or nearly plain so that very little lens step is formed. thus, the curved surface design of the reflecting mirror is important in determining the light distribution spread of the lamp.

SUMMARY OF THE INVENTION

1. Problems to be Solved by the Invention

To form a slant cutoff line peculiar to a downward-beam light distribution (15-degree slant) in vehicle illumination, it is not easy to provide a sufficient amount of light to a long-distance area or a medium-distance area positioned just below the line with the related-art reflecting mirror. Thus, there is a risk of hindering improved visibility on the line of the vehicle having the reflecting mirror.

It is therefore an object of the invention to design a curved reflecting surface which provides a sufficient amount of applied light in the range near a slant cutoff line in a downward-beam light distribution, thereby improving visibility in a long-distance region and a medium-distance region.

2. Means for Solving the Problem

The present invention is based on the premise that the basic reflecting face satisfies the following three requirements (a to c) to provide a light distribution pattern of a downward-beam having a slant cutoff line inclined with respect to a horizontal direction:

(a) A curve set in a horizontal reference face containing an optical axis, or a curve set in a slant reference face inclined—at a predetermined angle with the optical axis used as an axis of rotation—with respect to the horizontal reference face, is used as a reference curve;

(b) A light source body has a center axis extended along the optical axis and is placed near a reference point of the reference curve; and (c) The reflecting face is formed as a set of cross lines provided by cutting a virtual paraboloid of revolution having an axis parallel with a light beam vector of reflected light when light assumed to be emitted from the reference point of the reference curve positioned on the optical axis is reflected at an arbitrary point on the reference curve, wherein the paraboloid passes through the reflection point, and has the reference point as a focus on a virtual plane which contains the light beam vector and is parallel with a plane orthogonal with or inclined to the horizontal reference face or the slant reference face.

For a first reflecting area, close to the horizontal reference face when the reflecting face is viewed from the optical axis direction, a reference curve is set in a slant reference face inclined to the horizontal reference face at a first angle equal to the angle of the slant cutoff line with a horizontal line. Further, for a second reflecting area, positioned above or below the first reflecting area with respect to the horizontal reference face when the reflecting face is viewed from the optical axis direction, a reference curve is set in a slant reference face inclined to the horizontal reference face at a second angle larger than 0° and smaller than the angle of the slant cutoff line with the horizontal line.

Therefore, according to the invention, the projected image of the light source body provided by the first reflecting area is placed along the slant cutoff line just below the slant cutoff line, whereby a necessary amount of light is provided for distant forward visibility on the lane of the vehicle containing the head lamp. The projected image of the light source body provided by the second reflecting area is placed along a line having an angle smaller than the slant cutoff line, whereby an amount of light is provided to the medium-distance region forward on the lane of the vehicle containing the head lamp.

BRIEF DESCRIPTION OF THE DRAWINGS

The above and other objects and advantages of the present invention will become more apparent by describing in detail preferred embodiments thereof with reference to the accompanying drawings, wherein like reference numerals designate like or corresponding parts throughout the several views, and wherein:

FIG. 9 is a schematic representation for, together with FIG. 10, setting a plane inclined at a predetermined angle around an x axis with respect to an x-y plane to a reference plane, wherein FIG. 9 is a front view;

DETAILED DESCRIPTION OF THE INVENTION

1. Mode for Carrying out the Invention

A basic reflecting face and a method for forming it will be discussed with reference to FIGS. 1 to 10 in order to gain a better understanding of the description of a reflecting mirror and the method of forming it according to the present invention.

Figure 1:
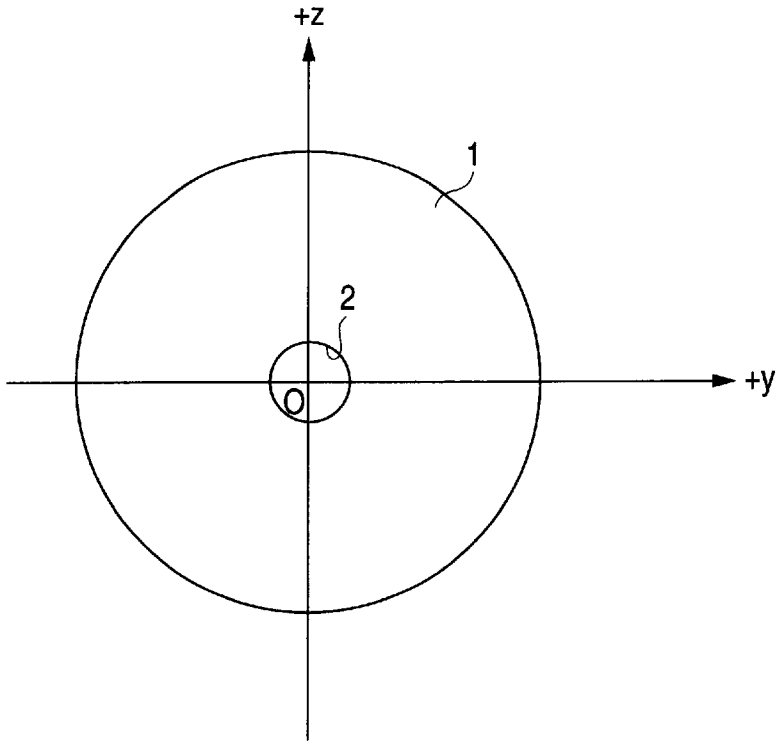
FIG. 1 is a drawing describing, together with FIGS. 2 to 10, a method of forming a reflecting face according to the invention, and is a front view of the reflecting face.

FIG. 1 is a front view schematically showing a basic face 1. For a three-dimensional rectangular coordinate system set with respect to the basic face 1, the optical axis extended perpendicularly to the paper face is selected as an x axis (the front side is assumed to be the positive direction), the horizontal axis orthogonal to the x axis is selected as a y axis (the right of the figure is assumed to be the positive direction), and the vertical axis is selected as a z axis (the top of the figure is assumed to be the positive direction). An intersection point O of the three axes is an origin point.

The basic face 1 is formed with a light source insertion hole 2 with the origin point O as the center viewed from the front.

Figure 2:
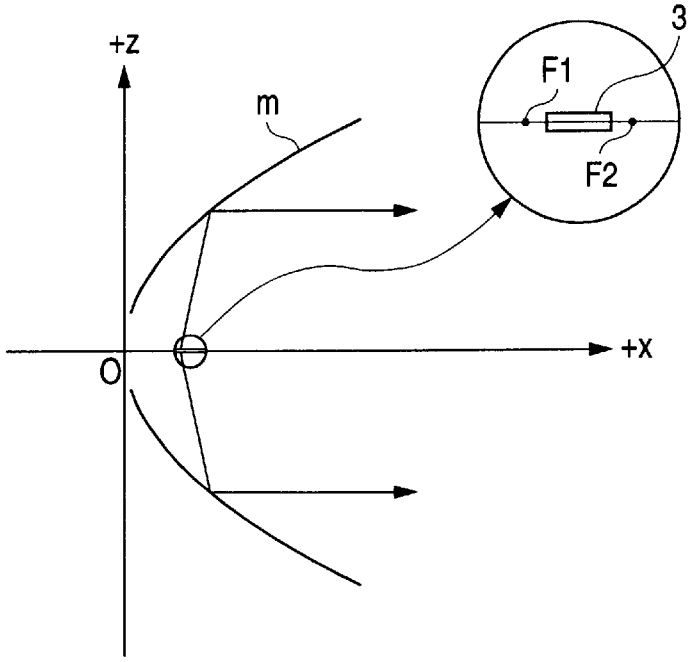
FIG. 2 is a longitudinal sectional view.

FIG. 2 is a drawing schematically showing the shape of a cross line m of the basic face 1 and the x-z plane. The line is shaped like a parabola having a focus F1 on the x axis. A point F2 is positioned ahead the focus F1 (in the positive direction of the x axis). It will turn out later that the focuses are reference points on curved line formation (focuses of a virtual revolution paraboloid). In the figure, for convenience of the description, the cross line m is a single parabola; however, for actual application to the reflecting face, the focus of the curve part positioned above the x-y plane needs to be set to F1 and the focus of the curve part positioned below the x-y plane needs to be set to F2 (to provide reflected light traveling downward with respect to the horizontal face).

A light source body 3 is placed within the reflecting mirror through the light source insertion hole 2. The center axis of the light source body 3 extends along the x axis of the optical axis and is positioned between the focuses F1 and F2.

An electric bulb, such as a tungsten halogen lamp, or a discharge lamp, such as a halide lamp, can be used as the light source. For example, to use an incandescent lamp, the light source body 3 is a filament. In this case, it is assumed that the ideal design shape is a cylinder. To place the filament with respect to the optical axis, the filament is placed so that its center axis matches the x axis, or the filament is placed in a state in which its center axis is parallel with the x axis and comes in contact with the x axis from above. To use a discharge lamp as the light source, the light source body 3 is an arc between discharge electrodes.

Figure 3:
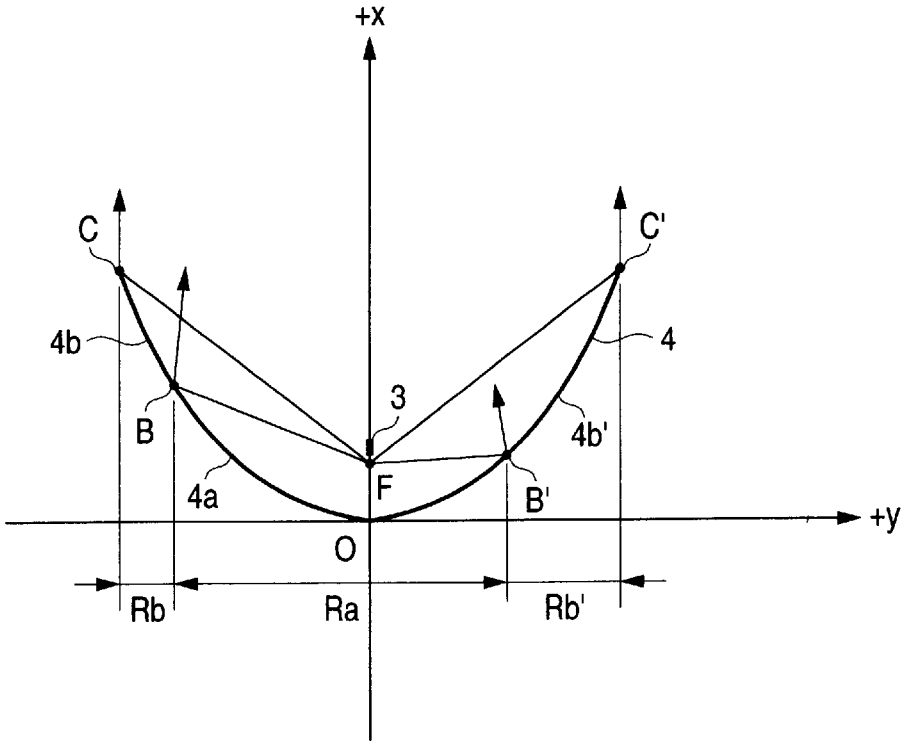
FIG. 3 is a transverse sectional view.

FIG. 3 schematically shows the shape of a reference curve 4 set in a horizontal reference face containing the x axis (or a horizontal reference plane corresponding to the x-y plane in the figure), namely, the intersection line of the basic face 1 and the x-y plane.

The reference curve 4 is not only a secondary curve that can be represented analytically in an expression, such as a parabola or an ellipse, but also is a free curve containing a splined curve, etc. In the latter case, a geometrical insight about the direction vector indicating the reflection direction at a point on the curve is required in curved surface design. For example, the reference curve 4 shown in the figure is formed as a splined curve made up of an "elliptical" or "hyperbolic" curve part 4*a* and parabolic curve parts 4*b*, 4*b*'. The curve part 4*a* has a focus F (corresponding to the focus F1 or F2) on the x axis (see the range shown as Ra in the figure). The "parabolic" curve parts 4*b* and 4*b*' are positioned on both sides of the curve part 4*a* (see the ranges shown as Rb and Rb'). The light source body 3 is positioned in the proximity of (ahead in the figure) the focus (or reference point) F of the reference curve 4.

The terms mentioned here "hyperbolic," "elliptical," and "parabolic" are terms defined depending on the aim direction of the reflected light beam at the reflection point on the reference curve 4—namely, what trend the direction of the reflected light beam has with respect to the straight line passing through the reflection point and parallel with the x axis—and are used as modifiers to direction vectors of the reflected light beam at the reflection point and curve parts forming parts of the reference curve 4.

Figure 4:
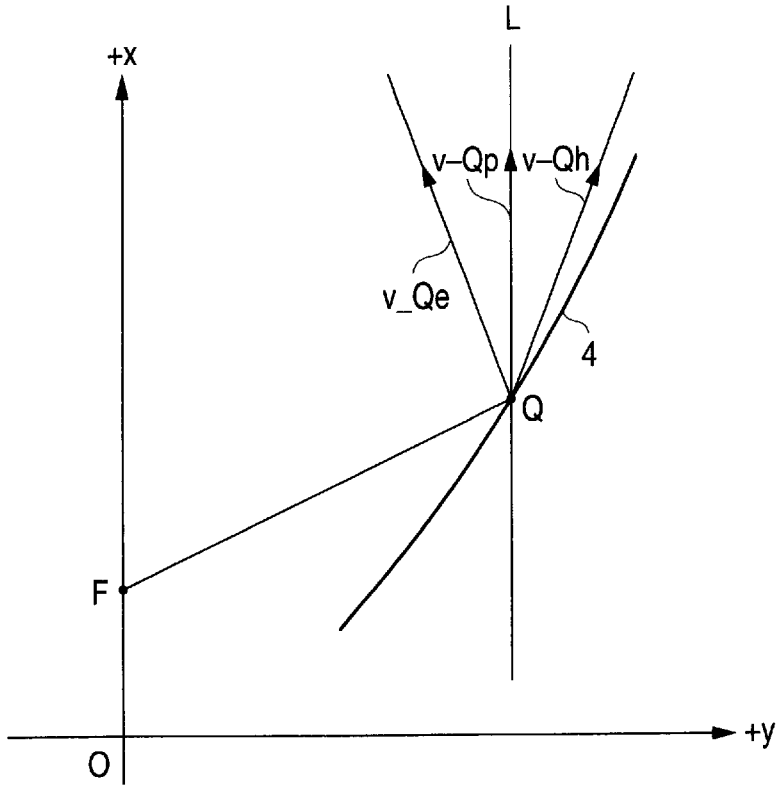
FIG. 4 is a schematic representation of direction vectors for a reflected light beam.

FIG. 4 shows the definition of the above-mentioned terms for the direction vectors of the reflected light beam.

Assuming that a point light source is placed at the focus F set on the x axis, three forms of unit direction vector are shown, and indicate the direction of the reflected light beam when light emitted from the point light source to a point Q on the reference curve 4 is reflected at the point Q. Vector v_Qp denotes a vector having the same direction as the positive direction of the x axis along a line L passing through the point Q and extended in parallel with the x axis, vector v_Qe denotes a vector whose tip approaches the x axis side, and vector v_Qh denotes a vector whose tip is directed away from the x axis.

Because light issued from the focus of a parabola and then reflected at a point on the parabola is parallel with the axis of the parabola, by analogy the vector v_Qp is defined as "parabolic." Similarly, because a reflected light beam emitted from one of the focuses of an ellipse and then reflected at a point on the ellipse crosses the long axis of the ellipse at an opposite focus, by analogy the vector v_Qe is defined as "elliptical." Further, because a reflected light beam emitted from one of the focuses of a hyperbola and then reflected at a point on the hyperbola is away from the axis of the hyperbola as it goes in the travel direction, by analogy the vector v_Qh is defined as "hyperbolic."

To expand the terms from the reflection direction vectors to curve parts, the following definitions are adopted paying attention to the fact that the reflection direction vector continuously changes at arbitrary points from an end point S to an end point E of the curve part:

"Hyperbolic curve part" is that the reflection direction vector at the end point S is "elliptical" or "parabolic" and that the direction of the reflection direction vector changes gradually as the reflection direction vector advances from the end point S to the end point E and the reflection direction vector at the end point E is "hyperbolic."

"Elliptical curve part" is that the reflection direction vector at the end point S is "hyperbolic" or "parabolic" and that the direction of the reflection direction vector changes gradually as the reflection direction vector advances from the end point S to the end point E and the reflection direction vector at the end point E is "elliptical."

"Parabolic curve part" is that the reflection direction vector at the end point S is "elliptical" or "hyperbolic" and that the direction of the reflection direction vector changes gradually as the reflection direction vector advances from the end point S to the end point E and the reflection direction vector at the end point E is "parabolic."

In short, the definitions are nothing but use of the terms indicating the reflection trend recognized finally at the end point E when the reflection trend recognized at the end point S of the curve part changes as it advances to the end point E for the curve part.

For example, using the terms, if it is assumed in the reference curve 4 shown in FIG. 3 that the direction vector of the reflected light beam at the intersection point O of the curve part 4*a* and the x axis is parabolic and that the direction vector of the reflected light beam at a boundary point B between the curve part 4*a* and the curve part 4*b* is elliptical, the portion of the curve part 4*a* from the point O to the point B is "elliptical". That is, the above-mentioned definitions are applied with the point O as the end point S and the point B as the end point E. Likewise, if it is assumed that the direction vector of the reflected light beam at a boundary point B' between the curve part 4*a* and the curve part 4*b*' is elliptical, the portion of the curve part 4*a* from the point O to the point B' is "elliptical." For the curve parts 4*b* and 4*b*', the reflection direction vectors at the points B and B' are elliptical and the reflection direction vectors at an end point C of the curve part 4*b* (the left end of the reference curve 4) and an end point C' of the curve part 4*b*' (the right end of the reference curve 4) are parabolic. Thus, it is easily seen that the curve parts 4*b* and 4*b*' are parabolic. Therefore, it is qualitatively understood that as the reflection trend at the points on the reference curve 4, the diffusion effect in the horizontal direction is recognized in the range Ra. It is also qualitatively understood that the reflection direction approaches the direction parallel with the x axis as it approaches the points C and C' in the ranges Rb and Rb'. In other words, description of the reflection trend concerning the reference line 4 without introducing the above-mentioned terms would require development of excessively mathematical discussion making free use of a large number of expressions.

If the shape of the reference curve 4 is thus determined, a curved surface can be formed according to the following procedure:

(1) Assume a virtual revolution paraboloid having an axis parallel with the light beam vector of reflected light when light assumed to be emitted from a reference point on an optical axis is reflected at an arbitrary point on the reference curve, wherein the paraboloid passes through the reflection point, and has the reference point as a focus.

(2) Assume a virtual plane containing the light beam vector and being parallel with a vertical axis (or a virtual plane containing the light beam vector and inclined with respect to a plane parallel with a vertical axis).

(3) Form a reflecting face as a set of cross lines (parabolas) provided when the virtual revolution paraboloid in (1) is cut on the virtual plane in (2) (cross line set).

Figure 5:
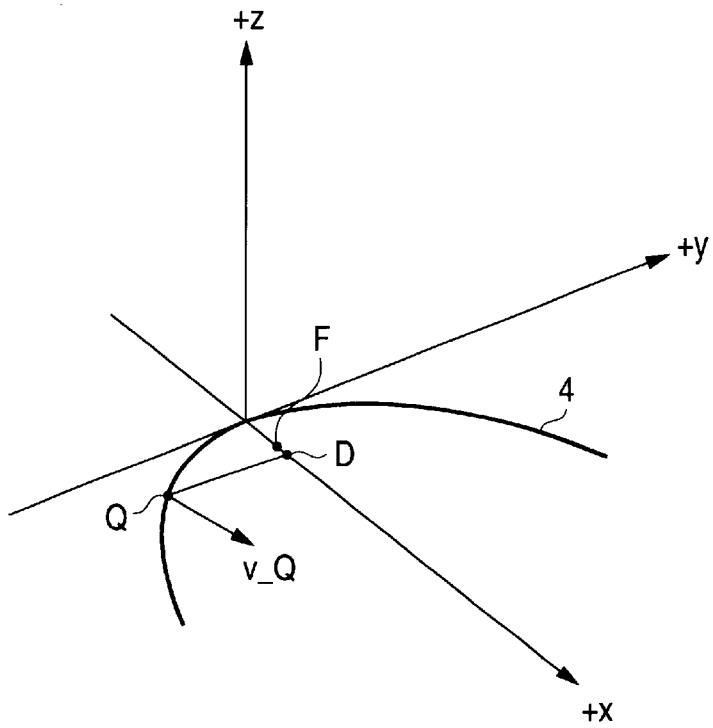
FIG. 5 is a perspective view showing a reference curve.
Figure 6:
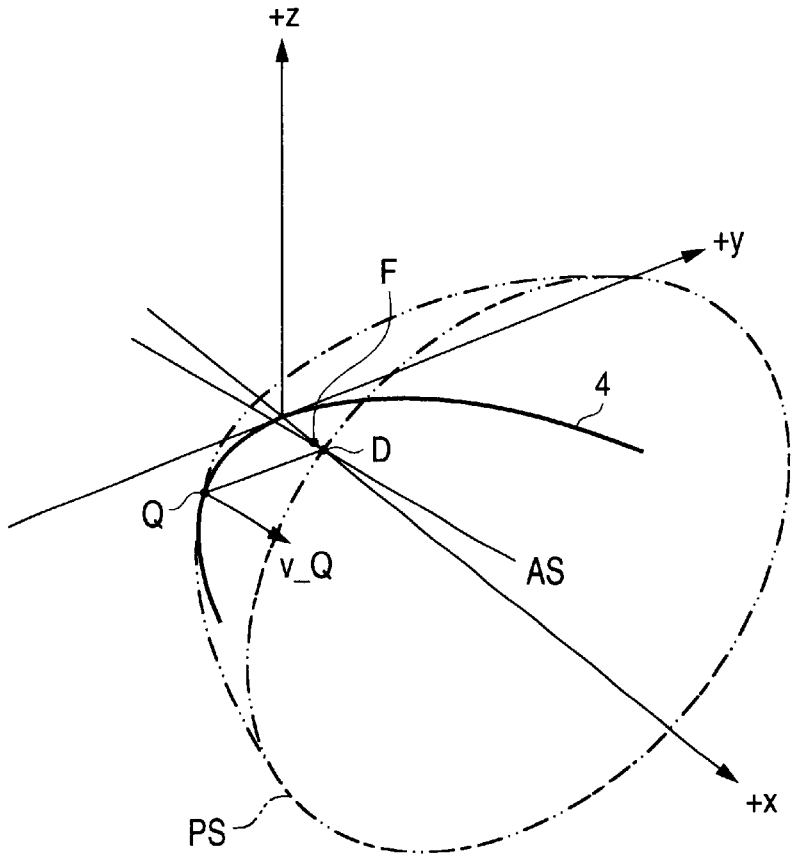
FIG. 6 is a perspective view showing a virtual paraboloid of revolution.

FIGS. 5 and 6 are schematic representations about step (1).

FIG. 5 shows the reference curve 4 set on the horizontal reference face (x-y plane). For a point Q on the curve, a direction vector v_Q of a reflected light beam at the position Q is determined uniquely. That is, when it is assumed that a point light source is placed at a reference point D set ahead or behind a focus F on the x axis, light emitted from the point light source and then reflected at the point Q proceeds in the direction of the direction vector v_Q.

FIG. 6 shows a virtual revolution paraboloid PS including the point Q. The virtual revolution paraboloid PS has the reference point D as the focus and an axis of rotational symmetry AS parallel with the vector v_Q and is a curved surface formed so that the point Q is positioned on the paraboloid PS.

Figure 7:
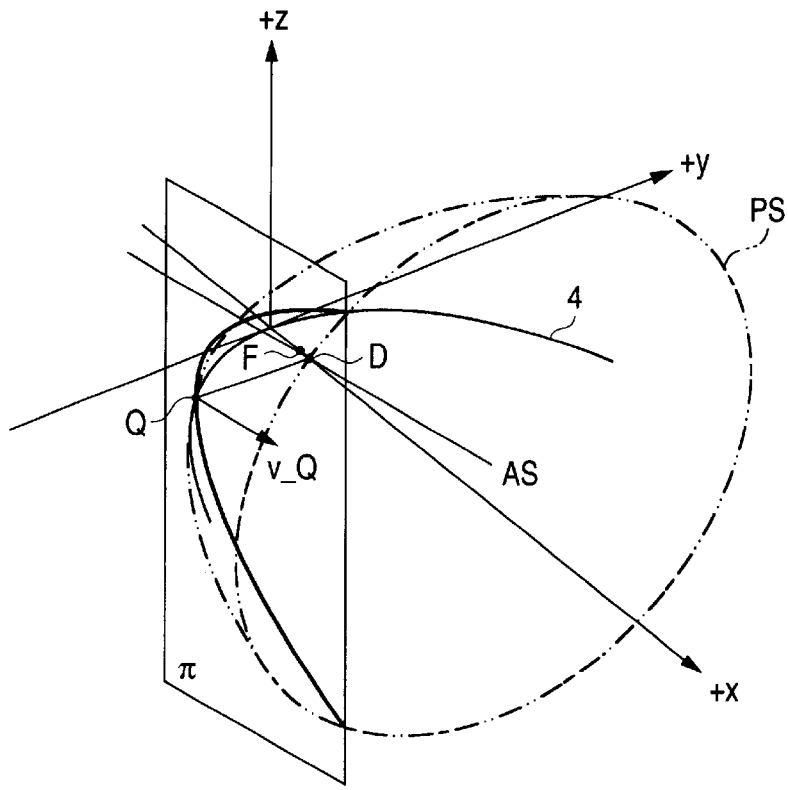
FIG. 7 is a perspective view showing cross lines (parabolas) of a virtual paraboloid of revolution, and showing a virtual plane.
Figure 8:
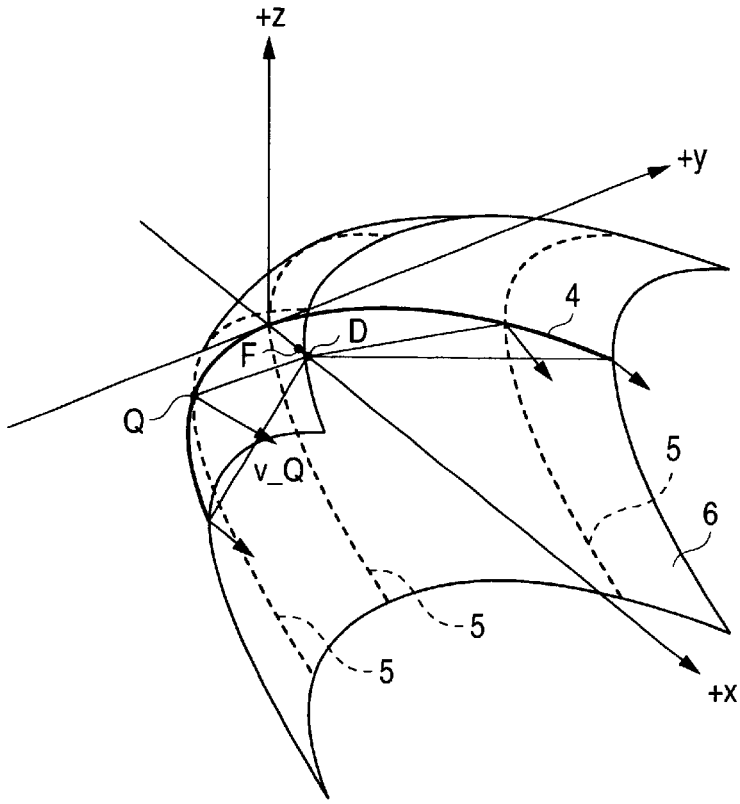
FIG. 8 is a perspective view showing a curved surface formed as a cross line group.

FIG. 7 is a schematic representation of step (2). A cross line resulting from cutting the virtual revolution paraboloid PS by a virtual plane $\pi$ passing through the point Q and parallel with the z axis becomes a parabola 5. Such a parabola is determined uniquely with respect to the arbitrary point Q on the reference curve 4. Thus, in step (3), as shown in FIG. 8, the parabolas 5, 5, . . . are given to the point Q along the reference curve 4, whereby a curved surface 6 is formed as a set of the parabolas, which curved surface 6 becomes a basic face. That is, the basic face is provided as an enveloping surface of the virtual revolution paraboloid along the reference curve 4.

In order to apply the above to a reflecting mirror of a vehicle head lamp, consideration of setting the reference point D at different positions in areas above and below the x-y plane of the reflecting face, etc., is required. The virtual plane $\pi$ can also be defined as a plane provided by slanting a plane, which passes through the point Q and is parallel with the z axis, with the cross line of the plane and the horizontal reference face as a rotation axis.

In the description given above, the reference curve 4 is set in the horizontal reference face. More generally, the reference curve is set in a slant reference plane inclined at a predetermined angle around the optical axis relative to the horizontal reference face and the steps (1) to (3) can be expanded.

Figure 9:
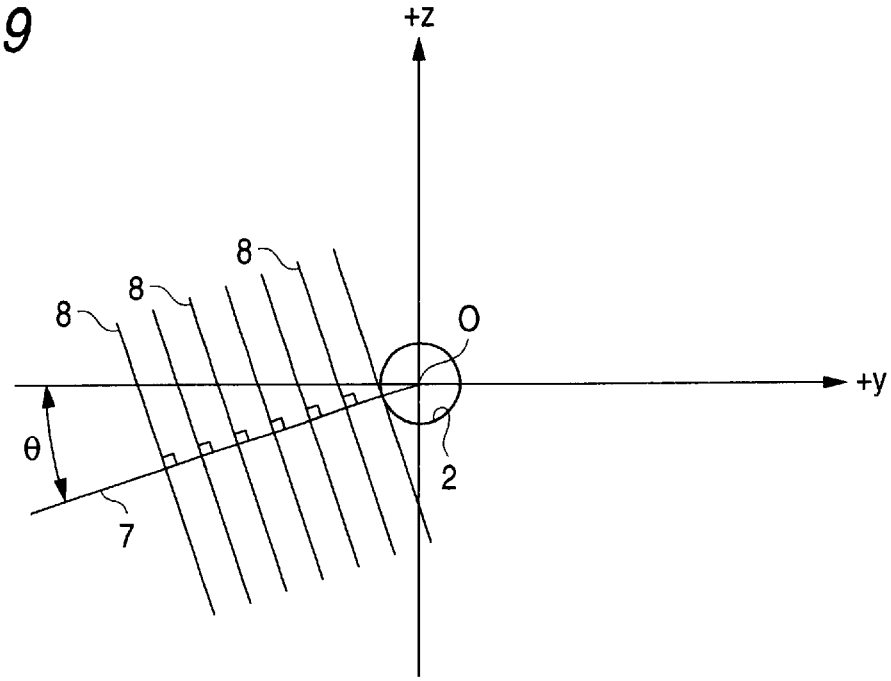

FIG. 9 shows a slant reference face (reference plane) 7 inclined at a predetermined angle ($\theta$), with the optical axis as an axis of rotation, relative to the horizontal reference face (x-y plane). A reference curve as shown in FIG. 3 is set in the face (plane).

In this case, the procedure of forming a curved surface is as follows: (See FIG. 10.)

(1) Assume a virtual revolution paraboloid having an axis parallel with the light beam vector of reflected light when light assumed to be emitted from the reference point D of a reference curve 4' is reflected at an arbitrary point on the reference curve 4', wherein the paraboloid passes through the reflection point, and has the reference point as a focus. The reference point needs to be set noting whether the reference point position is above the reflecting face (above the x-y plane) or below the reflecting face.

(2) Assume a virtual plane containing the reflected-light-beam vector in (1) and being inclined with respect to the vertical axis, i.e., a plane orthogonal to the slant reference face 7, indicated by lines 8, 8, . . . in FIG. 9. The virtual plane can also be defined as a plane provided by slanting a plane orthogonal to the slant reference face 7, wherein the cross line of the plane and the slant reference face is the axis of rotation.

(3) Form a reflecting face as a set of cross lines (parabolas) provided when the virtual revolution paraboloid in (1) is cut on the virtual plane in (2). That is, as shown schematically in FIG. 10, parabolas 9, 9, . . . are determined for each arbitrary point on the reference curve 4 (only the cross lines for each representative point are shown in the figure).

The shape of the basic face and its forming method now become clear. Thus, the reflecting face of the reflecting mirror according to the invention now will be discussed.

Figure 11:
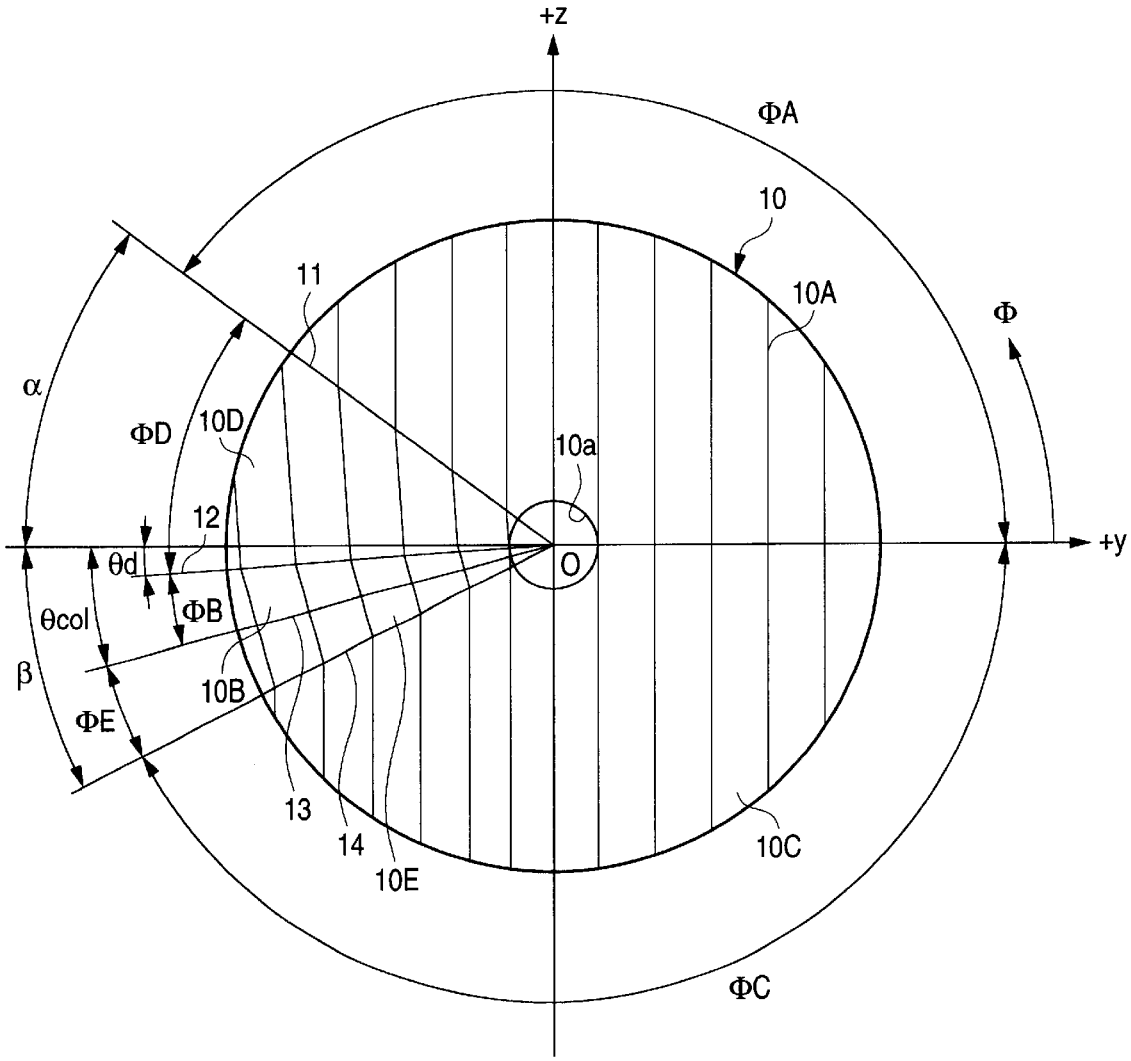
FIG. 11 is a front view showing an exemplary configuration of the reflecting face.

FIG. 11 is a front view describing an exemplary configuration of the reflecting face. For a three-dimensional rectangular coordinate system set with respect to the reflecting face, the optical axis extending perpendicularly to the paper face is selected as an x axis (the front side is assumed to be the positive direction), the horizontal axis orthogonal to the x axis is selected as a y axis (the night of the figure is assumed to be the positive direction), and the vertical axis is selected as a z axis (the top of the figure is assumed to be the positive direction). An intersection point O of the three axes (the center of a light source placement hole 10*a*) is an origin point.

In the example shown in FIG. 11, a reflecting face 10 comprises reflecting areas 10A, 10B, 10C, 10D, and 10E. When angle $\Phi$, as measured in the counterclockwise direction in the figure as the positive direction around the x axis with the positive axis of the y axis as the reference of 0°, is set and the occupation angle of each area is $\Phi X$ (X=A, B, C, D, E), the areas occupy the following ranges:

Reflecting area 10A ($0° < \Phi \leqq \Phi A$);

Reflecting area 10D ($\Phi A < \Phi \leqq \Phi A + \Phi D$);

Reflecting area 10B ($\Phi A + \Phi D < \Phi \leqq \Phi A + \Phi D + \Phi B$);

Reflecting area 10E ($\Phi A + \Phi D + \Phi B < \Phi \leqq \Phi A + \Phi D + \Phi B + \Phi E$); and Reflecting area 10C ($360° - \Phi C < \Phi \leqq 360°$).

Here, if an angle $\alpha$ ($0° < \alpha < 90°$) is defined as the angle which a boundary line 11 between the areas 10A and 10D (or a plane containing the boundary line and extended in the x axis direction) forms with the x-y plane (negative axis of y), and if an angle $\theta d$ is defined as the angle which a boundary line 12 between the areas 10D and 10B (or a plane containing the boundary line and extended in the x axis direction) forms with the x-y plane (negative axis of y), for example, the relations of "$\Phi D = \alpha + \theta d$," "$\Phi A = 180° - \alpha$," etc., are obtained.

If an angle $\theta col$ is defined as the angle which a boundary line 13 between the areas 10B and 10E (or a plane containing the boundary line and extended in the x axis direction) forms with the x-y plane (negative axis of y), the angle corresponds to the slant cut line angle in downward beam light distribution (the angle 15° of the slant cutoff line with the horizontal line). If an angle $\beta$ ($\theta col < \beta \leqq 90°$) is defined as the angle which a boundary line 14 between the areas 10E and 10C (or a plane containing the boundary line and extended in the x axis direction) forms with the x-y plane (negative axis of y), for example, the relations of "$\theta d + \Phi B + \Phi E = \beta$," "$\Phi C = 180° - \beta$," etc., are obtained.

The boundary lines are shown in the figure for convenience of the description of the area divisions of the reflecting face 10 and, it should be noted, the actual curved surface is a continuous curved surface without any level difference on the boundary lines (namely, the boundary lines are virtual).

Figure 10:
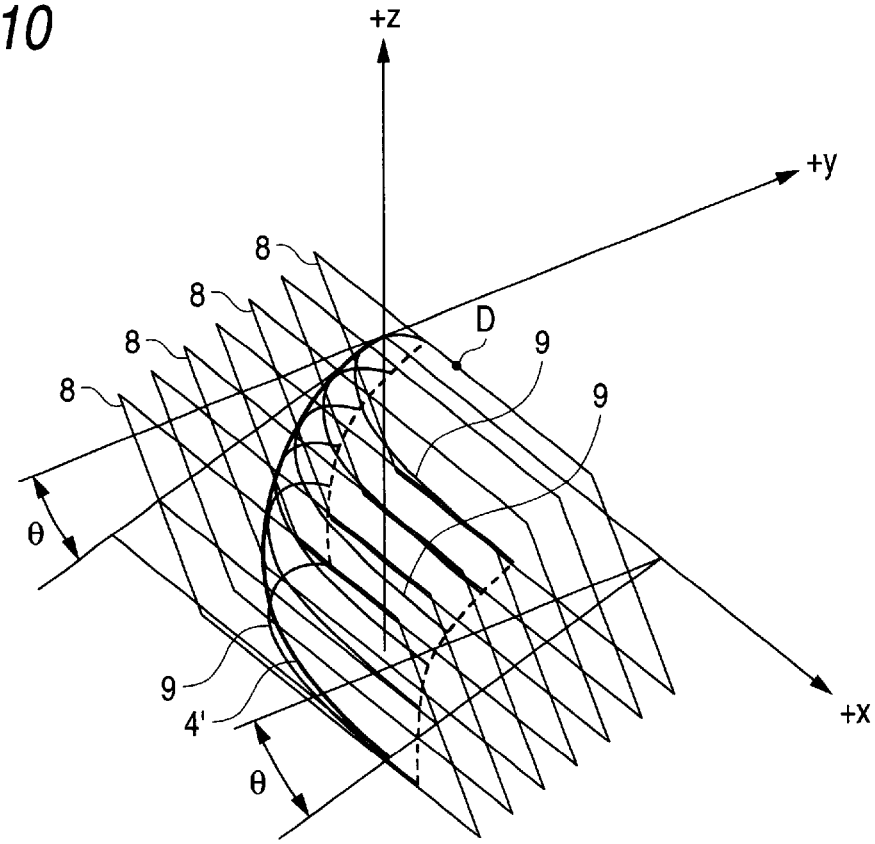
FIG. 10 is a perspective view to show the relationship between a reference plane, a virtual plane, and cross lines in the virtual plane.

The vertical lines and slant lines shown in the reflecting areas representatively illustrate some of the parabolas associated with each point of the reference curve set in the horizontal reference face, or the slant reference face, and are not actually visually recognized (see the parabolas in FIGS. 8 and 10).

First, the reflecting area 10A, occupying the range from the first quadrant of the y-z plane to a part of the second quadrant, has a reference curve in the x-y plane of the horizontal reference face (namely, using the symbol of A added to $\theta$ mentioned above, "$\theta A = 0°$" is set). And the parabolas associated with points on the reference curve are contained in planes orthogonal to the x-y plane.

Figure 12:
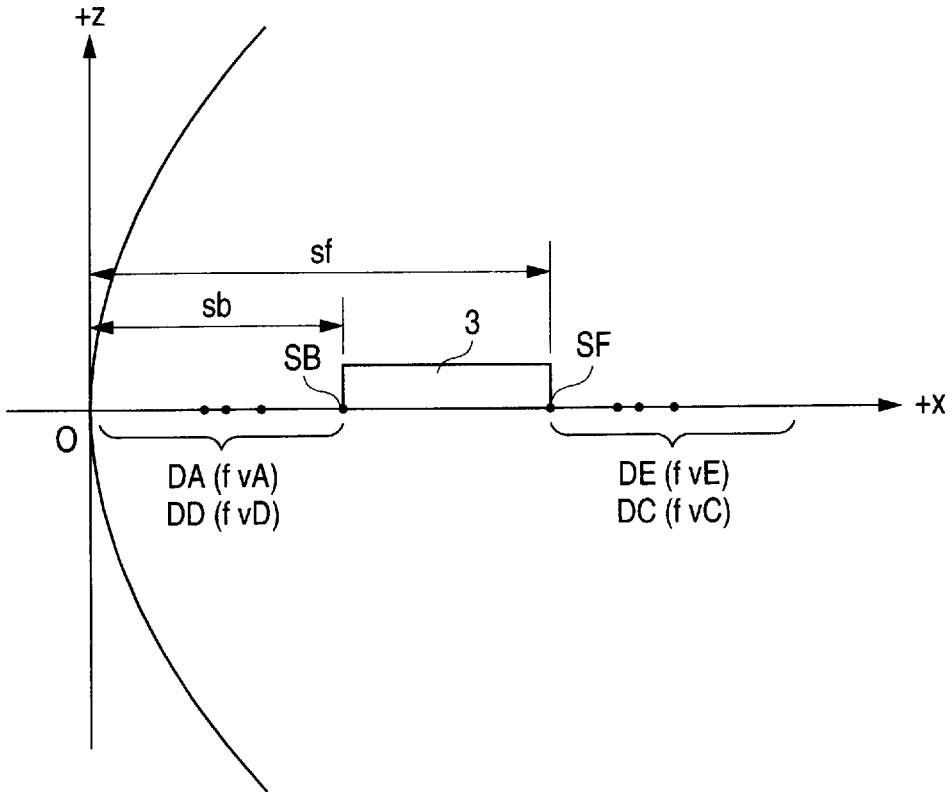
FIG. 12 is a side view describing how reference points are set.

FIG. 12 is a drawing to describe a light source body 3 placed along the optical axis (x axis) and setting of reference point D (virtual focus). The meanings of points SB and SF are as follows:

SB: Positive projective point of the rear end of the light source body 3 (end close to the z axis) onto the x axis, wherein its distance from the origin point O is described as sb.

SF: Positive projective point of the front end of the light source body 3 (end far from the z axis) onto the x axis, wherein its distance from the origin point O is described as sf.

In the figure, the side of the light source body 3 touches the x axis, but the placement is not so limited, and can be a placement wherein the center axis of the light source body matches the x axis, or any placement between the previous two placements.

A reference point DA of the reflecting area 10A is set at the point SB or behind the point SB. That is, if the distance from the origin point O to the reference point DA is described as fvA, $0<fvA\leqq sb$. The reason is that the projection pattern based on the reflecting area 10A needs to be made downward because the area is positioned above the x-y plane.

For the reflecting area 10D, positioned across a part of the second quadrant of the y-z plane and the third quadrant, a reference curve is set in a plane inclined at an angle of θd with respect to the horizontal reference face (x-y plane) with the x axis as a rotation axis (the plane slanted downward at the angle θd with the negative y axis is the reference plane and, using the symbol of D added to θ mentioned above, "θD=θd." That is, this case corresponds to the case of "θ=θd" in FIGS. 9 and 10). The parabolas associated with points on the reference curve are contained in planes orthogonal to the slant reference plane. For the reflecting area 10D, diffused light in the direction forming the angle θd ($0°<\theta d\leqq\theta col$) with the horizontal line below the slant cutoff line can be provided by waving processing described later.

As shown in FIG. 12, a reference point DD of the reflecting area 10D is set at the point SB or behind the point SB. That is, if the distance from the origin point O to the reference point DD is described as fvD, the reference point DD is set in the range of $0<fvD\leqq sb$.

The reflecting area 10D has a role of applying, in addition to the amount of light applied by the reflecting area 10B, an amount of light in the light forming the range just below the slant cutoff line in a downward-beam light distribution.

For the curved surface shape in the reflecting area 10B, adjacent to the area 10D in the third quadrant of the y-z plane, a rotation symmetrical face is used with the x axis as an axis of rotation . That is, reflecting area 10B is a rotation body produced by rotating the reference curve around the x axis, for example, when the reference curve is a parabola, i.e., reflecting area 10B is a paraboloid of revolution. The focus position is set, for example, at the point SF or ahead or behind the point SF, or at the point SB or ahead or behind the point SB, so that light reflected by the reflecting area 10B contributes as. light forming the range just below the slant cutoff line in a downward-beam light distribution.

For the reflecting area 10E, a reference curve is set in a plane inclined at an angle of θcol with respect to the horizontal reference face (x-y plane) with the x axis as a rotation axis. That is, the plane slanted downward at the angle θcol with the negative y axis is the reference plane, and using the symbol of E added to θ mentioned above, "θE=θcol." The parabolas associated with points on the reference curve are contained in planes orthogonal to the slant reference plane.

As shown in FIG. 12, a reference point DE, of the reflecting area 10E, is set at the point SF or ahead of the point SF. That is, if the distance from the origin point O to the reference point DE is described as fvE, the reference point DE is set in the range of $sf\leqq fvE$. However, the longer fvE, the more downward applied light and, thus, its upper limit value is determined in relationship with the application range of light ahead of the vehicle.

For the reflecting area 10C, positioned across a part of the third quadrant of the y-z plane and in the fourth quadrant, a reference curve is set in the horizontal reference face (x-y plane). Thus, using the symbol of C added to θ, "θC=0°". The parabolas associated with points on the reference curve are contained in planes orthogonal to the horizontal reference face.

As shown in FIG. 12, a reference point DC of the reflecting area 10C is set at the point SF or ahead of the point SF. That is, if the distance from the origin point O to the reference point DC is described as fvC, the reference point DC is set in the range of $sf\leqq fvC$.

Figure 13:
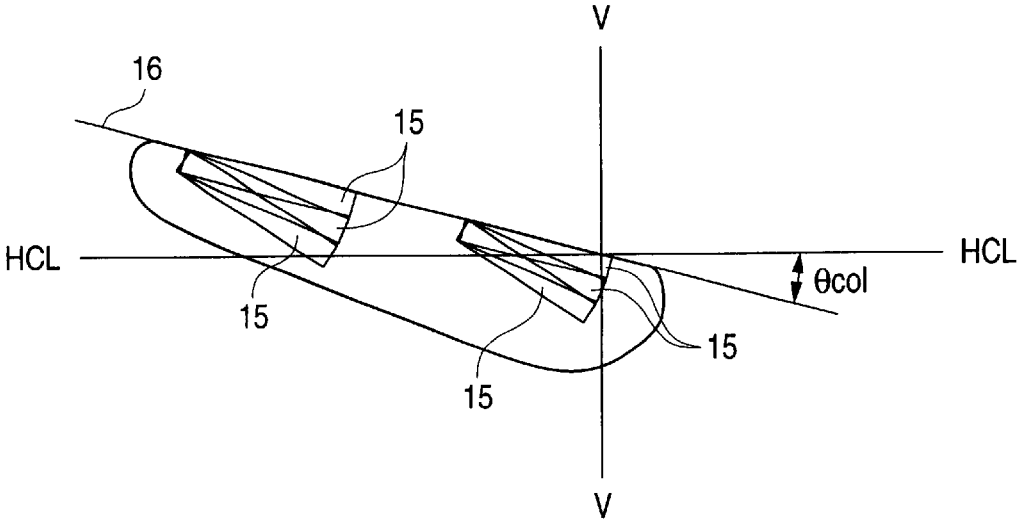
FIG. 13 is a schematic representation showing the placement trend of filament images provided by an area 10E.
Figure 14:
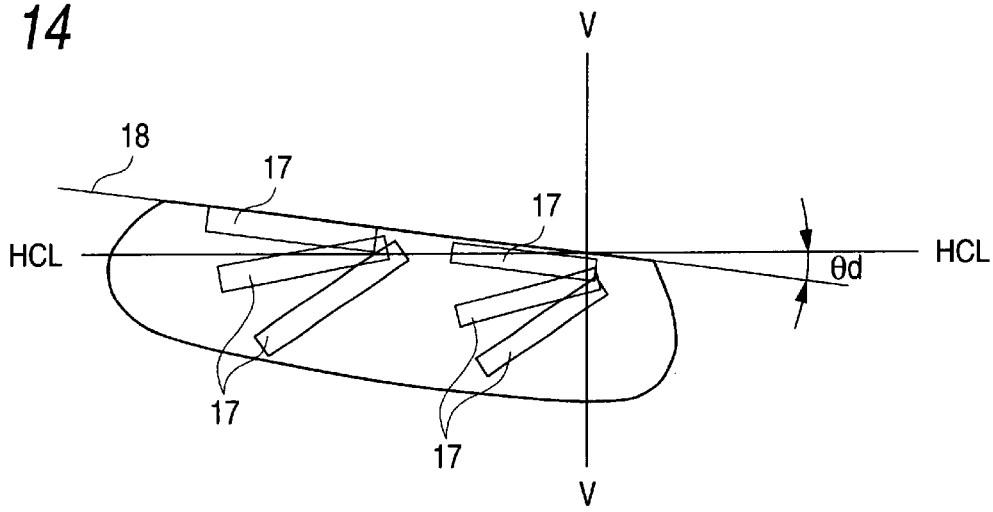
FIG. 14 is a schematic representation showing the placement trend of filament images provided by an area 10D.

FIGS. 13 and 14 schematically show the placement trend of filament images projected forward by a reflecting area (projection images) if a filament is used as the light source body 3 along the x axis direction with respect to the reflecting face 10. In the figures, a line HCL—HCL denotes a horizontal cutoff line (a line positioned slightly below the horizontal reference line and extended in the horizontal direction) and a line V—V denotes the vertical line.

FIG. 13 shows filament images 15, 15, . . . forwardly projected by the reflecting area 10E. The filament images are placed below a line 16 extending a leftward and upward slanting direction at the angle θcol with the HCL—HCL line (see the dashed line). Diffused light in the slanting direction at the angle θE (=θcol) with the HCL—HCL line can be provided by waving processing (described later), whereby an amount of light in the direction along the slant cutoff line is provided, and the visibility in the left distant region is improved. That is, light is made to arrive at a distant place in a region on the lane of the vehicle containing the headlamp.

The amount of light applied from the reflecting area 10E can be changed by adjusting the value of the angle ΦE involved in the occupation range mentioned above; if the amount of light is less than the lower limit value, it is insufficient for accomplishing the purpose of ensuring a minimum amount of light and, on the other hand, if the amount of light exceeds the upper limit value, there is a risk that the light may become excessive.

FIG. 14 shows filament images 17, 17, . . . forwardly projected by the reflecting area 10D. The filament images are placed below a line 18 extending in a leftward and upward slanting direction at the angle θd with the HCL—HCL line (see the dashed line). Diffused light in the slanting direction at the angle θD (for example, θd) with the HCL—HCL line can be provided by waving processing (described later), whereby the visibility in a medium-distance region positioned a little below the slant cutoff line is improved. That is, visibility of a region containing the shoulder on the lane of the vehicle containing the head lamp is improved.

Because fvD is set smaller than sb, and is placed behind sb, applied light is directed downward. The direction of applied light may be adjusted by moving the reference point DD along a direction parallel with the y axis or the z axis.

For the range of the angle θd, it is evident that the applied light based on the area 10D is not applied above the slant cutoff line exceeding the angle θcol and that the application purpose cannot be accomplished below the HCL—HCL line. The applied light amount based on the reflecting area 10D can be changed by adjusting the value of the angle ΦD involved in the occupation range; if the applied light amount is less than the lower limit value, it is insufficient for accomplishing the purpose of ensuring a minimum amount of light in the medium-distance region, and if the applied light amount exceeds the upper limit value, there is a risk that the applied light may become excessive.

Although θd may be set equal to θcol, it is more effective to set θE=θcol, because the side margin of the filament image in the length direction thereof, based on the reflecting area 10E, is extended along the slant cutoff line and thus the line can better be enhanced.

Although not shown, the filament image based on the reflecting area 10B is placed like a radiation peculiar to a rotation symmetrical face and is positioned just below the slant cutoff line.

The projection images of the filament, based on the reflecting areas 10A and 10C, are all placed below the HCL—HCL line. For example, an inflexion point exists on the boundary line between the areas 10E and 10C and, thus, the position of the filament image largely changes to a lower position of the HCL—HCL line immediately when the image enters the area 10C from the area 10E along a counterclockwise direction in FIG. 11. For the reflecting area 10A, as fvA is made shorter, the short-distance region ahead the vehicle (the region near to the vehicle) can be made brighter; this point is effective in application to two-wheeled vehicles, trucks, etc.

To brighten the region just below the cutoff line, the distances are set so that "fvA=fvD=sb" and "fvC=fvE=sf". At such a time, occurrence of glare light introduces a problem and, thus, generally the points DA, DD, DC, and DE often are set a short distance away from the points SB and SF.

On the reflecting face 10, parabolas are put on the reference curve set on each boundary between the reflecting areas in a direction orthogonal to a plane containing the reference curve (or in a slanting direction to the orthogonal direction), thereby forming a curved surface. Thus, the boundaries between the reflecting areas are concatenated without any level difference. Additionally, the projection images of the light source body by the reflecting areas are all placed in the range below the slant cutoff line, and the horizontal cutoff line, whereby occurrence of upward light causing glare can be minimized. The light distribution spread can be adjusted by setting the focus position of each parabola set (the cross lines of the virtual paraboloid of revolution PS and the virtual planes π) in the longitudinal direction (orthogonal direction to the reference plane or the slating direction to the orthogonal direction) and setting the above-mentioned angles θD and θE.

Figure 15:
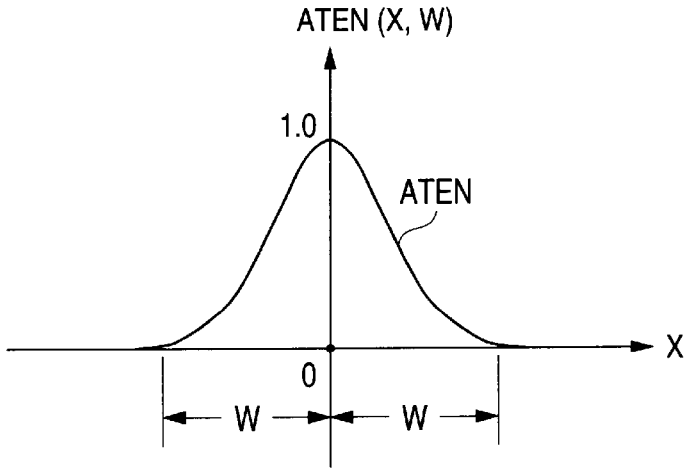
FIG. 15 is a graph showing an example of a normal distribution type function.

The degree of light diffusion further can be enhanced by adding the following waving operation to the reflecting face 10:

First, a normal distribution type (or Gauss distribution type) function using parameters X and W "Aten (X, W)=exp (−(2 X/W)^2)" is provided. The function exp( ) denotes an exponent function, "^" denotes a power, and the parameter W defines the degree of attenuation. FIG. 15 shows the form of the function Y=Aten (X, W).

Figure 16:
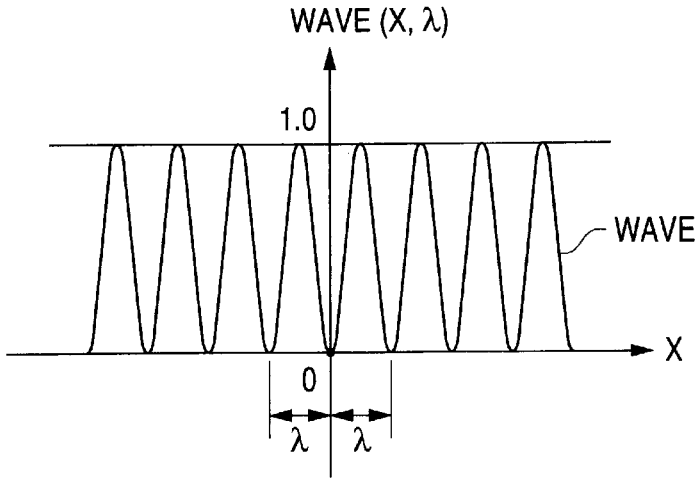
FIG. 16 is a graph showing an example of a periodic function.
Figure 17:
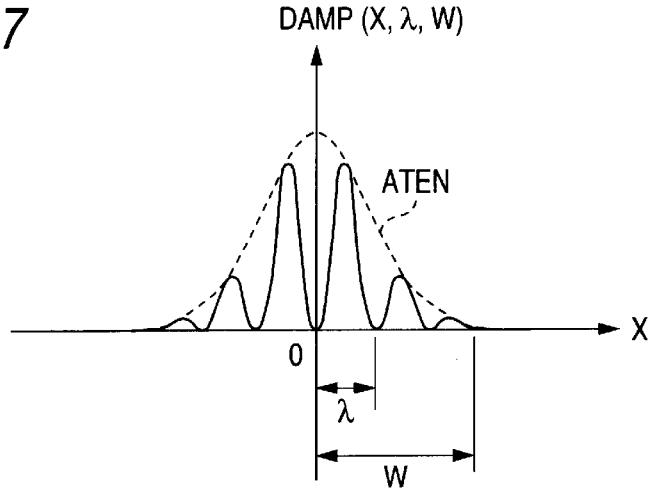
FIG. 17 is a graph showing an example of an attenuation periodic function.

Next, a periodic function using parameters W and λ "WAVE (X, λ)=(1−cos (360° X/λ))/2" is provided. The parameter λ denotes the number of cosine waves, namely, the wave interval. FIG. 16 shows the form of the function Y=WAVE (X, λ). In the example, the cosine function is used as the periodic function WAVE, but various periodic functions can be used as required.

Setting the parameter W to W=λ Ts and defining a function of multiplying the function Aten (X, W) by the function WAVE (X, λ) as Damp (X, λ, W), the function Y=Damp (X, λ, W) becomes a periodic function attenuated as it goes to the periphery of X=0 s the center.

The value of such an attenuation periodic function is added to an expression or data value of the reflecting face, whereby the reflecting face can be provided with a diffusion effect. Thus, control can be performed so that the reflected light by the portion near to the optical axis can be diffused. Further, control can be performed so that the light reflected by peripheral portions—away from the optical axis—of the reflecting face contributes to forming the central light intensity portion and surrounding portions in the light distribution pattern.

Such face waving need not always be performed for the full reflecting face, but can be performed for a part of the face.

Figure 18:
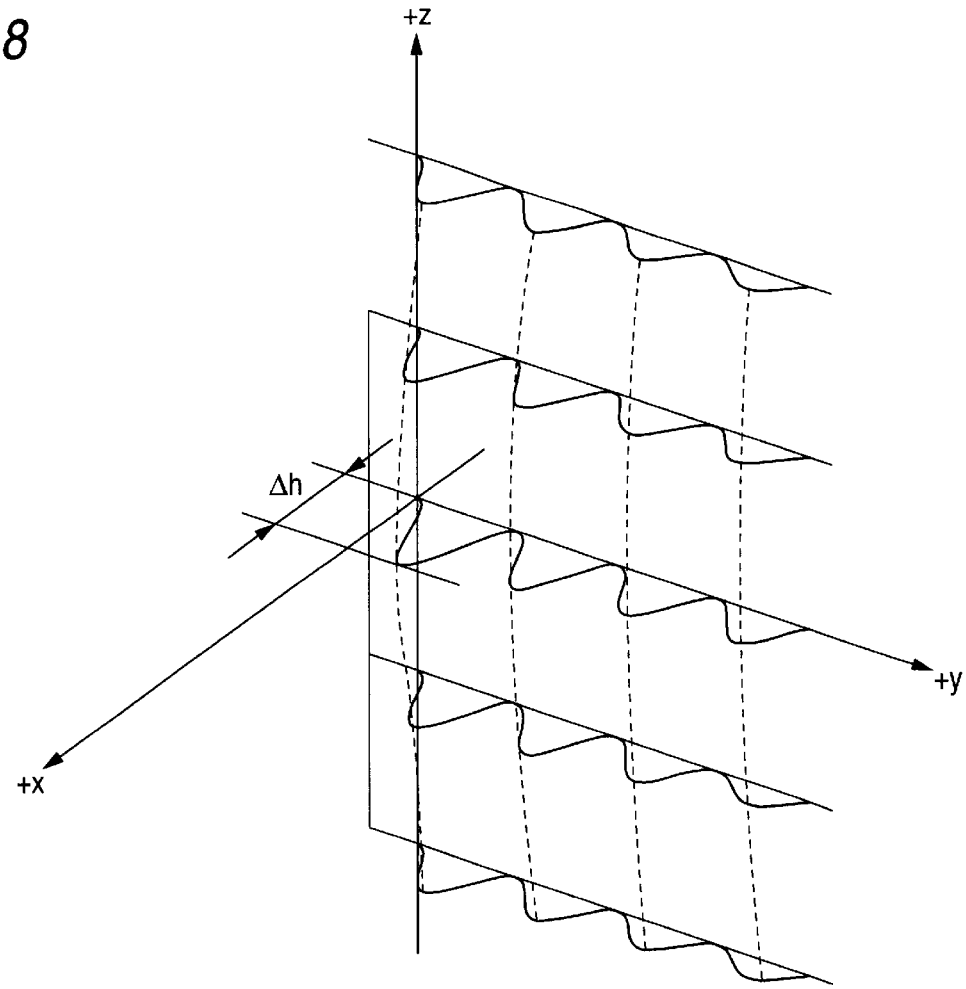
FIG. 18 is a drawing describing how height is set in an x axis direction according to waving processing.

The height of the wave part based on the peak value of the normal distribution type function is not made a constant value. Preferably the peak value of the normal distribution type function is changed so that the wave height (see Δh in FIG: 18) becomes lower at a place more distant from the horizontal reference face of the reflecting face containing the optical axis, as schematically shown in FIG. 18. The reason is that if the peak value of the normal distribution type function is made a constant value independently of the z value of the reflecting face, the projection image of the light source body—depending on the range onto both top and bottom ends of the reflecting face, particularly the projection image extended in the longitudinal direction (z direction)—may be diffused in the lateral direction more than necessary. Thus, there is a risk that the road face portion, toward the front of the vehicle, may be insufficiently illuminated. To solve this problem of insufficient illumination, it is desirable to design the reflector's shape so that the wave height (x value) becomes lower continuously or gradually with the top end or the bottom end of the reflecting face. In comparison between the continuous height change and the gradual height change, the former is preferred from the point of making it possible to perform more detailed light distribution control. But to locally change the wave height, namely, to relatively enlarge Ah in one range and relatively lessen Δh in another range, the latter is an easy method.

The forming method of the reflecting face according to the invention described above is summarized as follows:

(1) Setting area partitions of reflecting face—also called the boundary face, namely, the face on which reference curve is set-and setting the light source body.

For the boundary face, a horizontal reference face containing the optical axis, or a slant reference face inclined at a predetermined angle with the optical axis which is used as an axis of rotation, is set and a reference curve is set in the reference face. The light source body is inserted into the reflecting mirror through the light source body insertion hole made at the center of the reflecting face. Further, the light source body is set so that the center axis of the light source body is extended along the optical axis and is positioned in the proximity of the reference point of the reference curve.

Then, for the first reflecting area positioned close to the horizontal reference face, the reference curve is set in the slant reference face inclined at a first angle (θ1)—which is equal to the angle of a slant cutoff line with the horizontal line—with respect to the horizontal reference face (θcol). If the face shape of the first reflecting area is made as a face that is rotationally symmetrical about the optical axis (rotation body), of course the reference curve based on such rotation is also contained in the slant reference face.

For the second reflecting area positioned close to the horizontal reference face and above the reference face, the reference curve is set in the slant reference face inclined at a second angle (θ2), smaller than the angle of the slant cutoff line with the horizontal line, with respect to the horizontal reference face (0°<θ2<θ1).

(2) Shape design of the reference curve.

The shape of the reference curve set in the horizontal reference face or the slant reference face in (1) is determined. This means that the reference point is set and the reflection trend at points on the reference curve is defined.

(3) Setting a virtual paraboloid of revolution.

A virtual paraboloid of revolution is set having an axis parallel with the light beam vector v_Q, of reflected light when light assumed to be emitted from the reference point of the reference curve positioned on the optical axis is reflected at an arbitrary point Q on the reference curve, wherein the paraboloid passes through the reflection point Q, and has the reference point as a focus.

(4) Setting a virtual plane and calculating a cross line.

A cross line (parabola) is found from the result of cutting the virtual paraboloid of revolution PS on the virtual plane π parallel with a plane having the light beam vector v_Q, and either perpendicular to the horizontal reference face or perpendicular to the slant reference face.

(5) Generating an enveloping surface as a cross line set.

A curved surface is formed as a set of cross lines provided by repeating the operations in (3) and (4) at the arbitrary point Q on the reference curve. The operations are performed for all reflecting areas.

(6) Waving processing.

The full reflecting face, or a part thereof, is formed like waves by performing an additional operation on the expression, or the data value, of the reflecting face based on the function of the product of a normal distribution type function and a periodic function.

Next, in order, some various forms of shape designs (I–VI) using the basic face described above will be discussed.

Form (I) is one which ensures a sufficient amount of applied light in medium-distance and long-distance regions ahead of the vehicle according to a projection pattern provided by the reflecting areas positioned above and below the horizontal reference face containing the optical axis.

Figure 19:
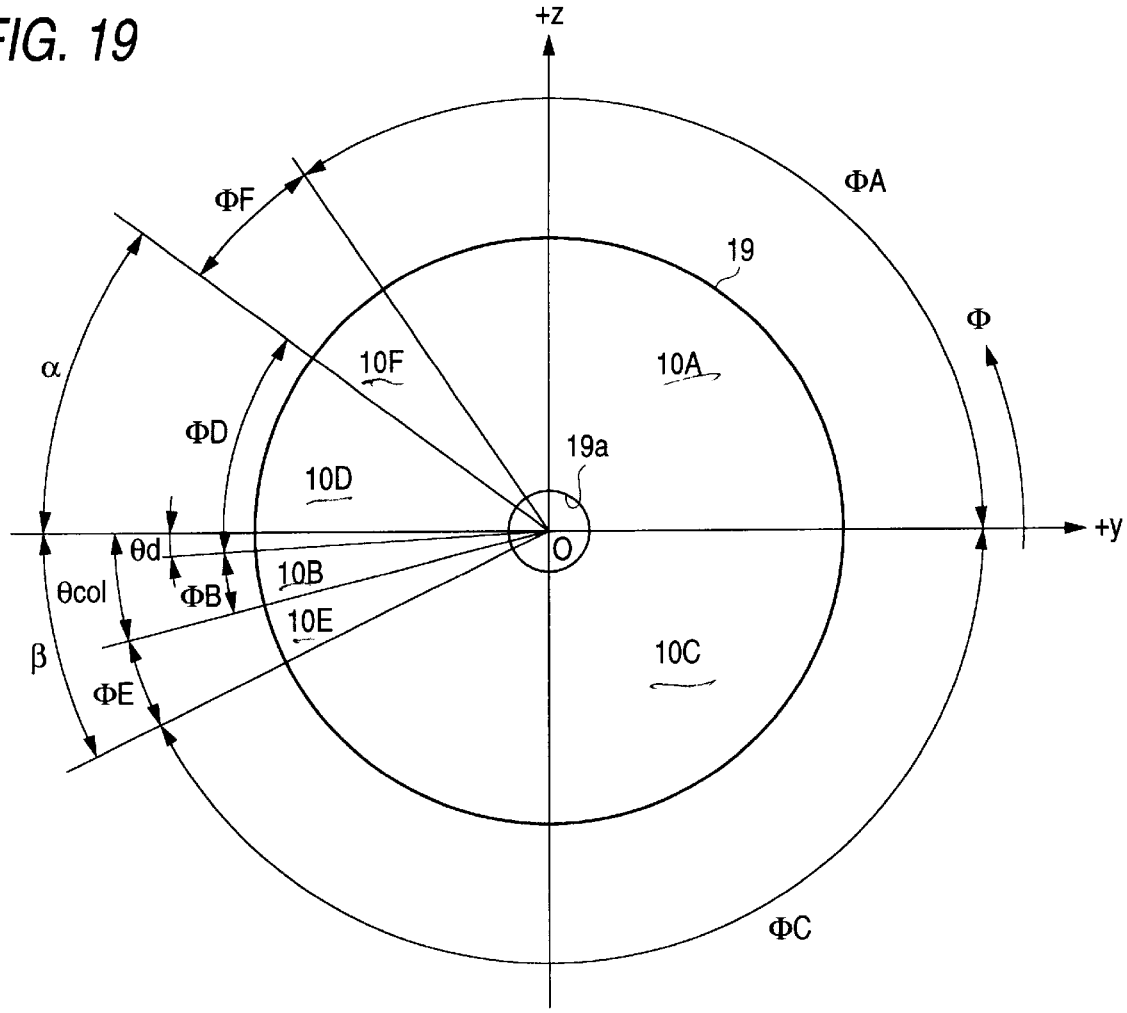
FIG. 19 is a drawing describing, together with FIG. 20, an exemplary configuration of a reflecting face, and is a front view of the reflecting face.
Figure 20:
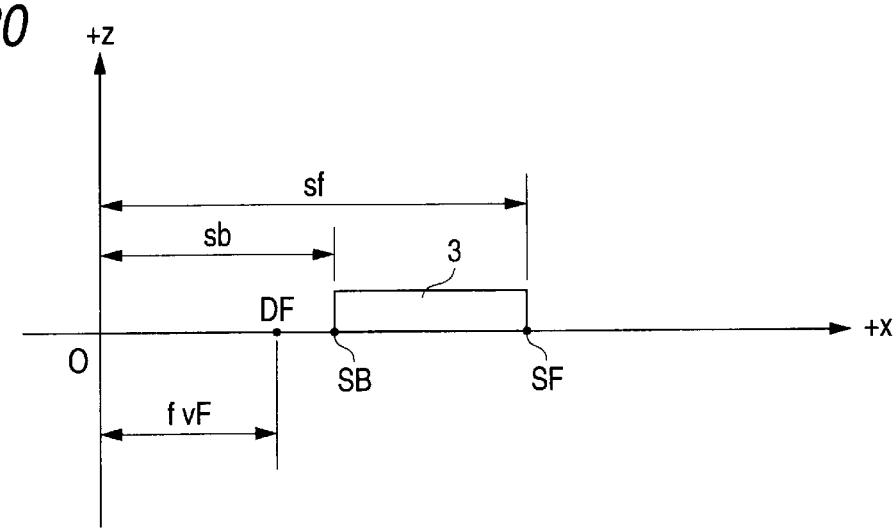
FIG. 20 is a side view describing how to set a reference point.

FIGS. 19 and 20 show exemplary configurations of the form in (I).

FIG. 19 is a front view of a reflecting face 19 having a light source placement hole 19*a*. The reflecting face 19 is made up of reflecting areas 10A to 10F, wherein 10A, 10F, 10D, 10B, 10E, and 10C are placed in order in a counterclockwise direction from the positive y axis. The coordinate axes concerning the reflecting face 19 and setting the angle axis Φ, are the same as those previously described. Further, the reflecting areas 10A to 10E are as described above and, therefore, will not be discussed again.

In the example, the newly added reflecting area 10F is positioned between the reflecting areas 10A and 10D and a reference curve is set in a plane inclined at an angle of θF ($0<\theta F\leqq\theta col$) with the horizontal reference face (x-y plane) with the x axis as a rotation axis. The parabolas associated with points on the reference curve are contained in a plane orthogonal to the slant reference plane.

A reference point DF, of the reflecting area 10F, is set at the point SB or behind the point SB, as shown in FIG. 20. That is, if the distance from the origin point O to the reference point DF is described as fvF, the reference point DF is set so that $0<fvF\leqq sb$. The shorter fvF, the more downward light reflected from area 10F becomes.

For example, if the angle value of θF is set to about 4°, and the value of θD is set to about 8°, the application patterns provided by the reflecting areas 10D and 10F contribute to application of light to the medium-distance region on the lane of the vehicle containing the head lamp.

Figure 21:
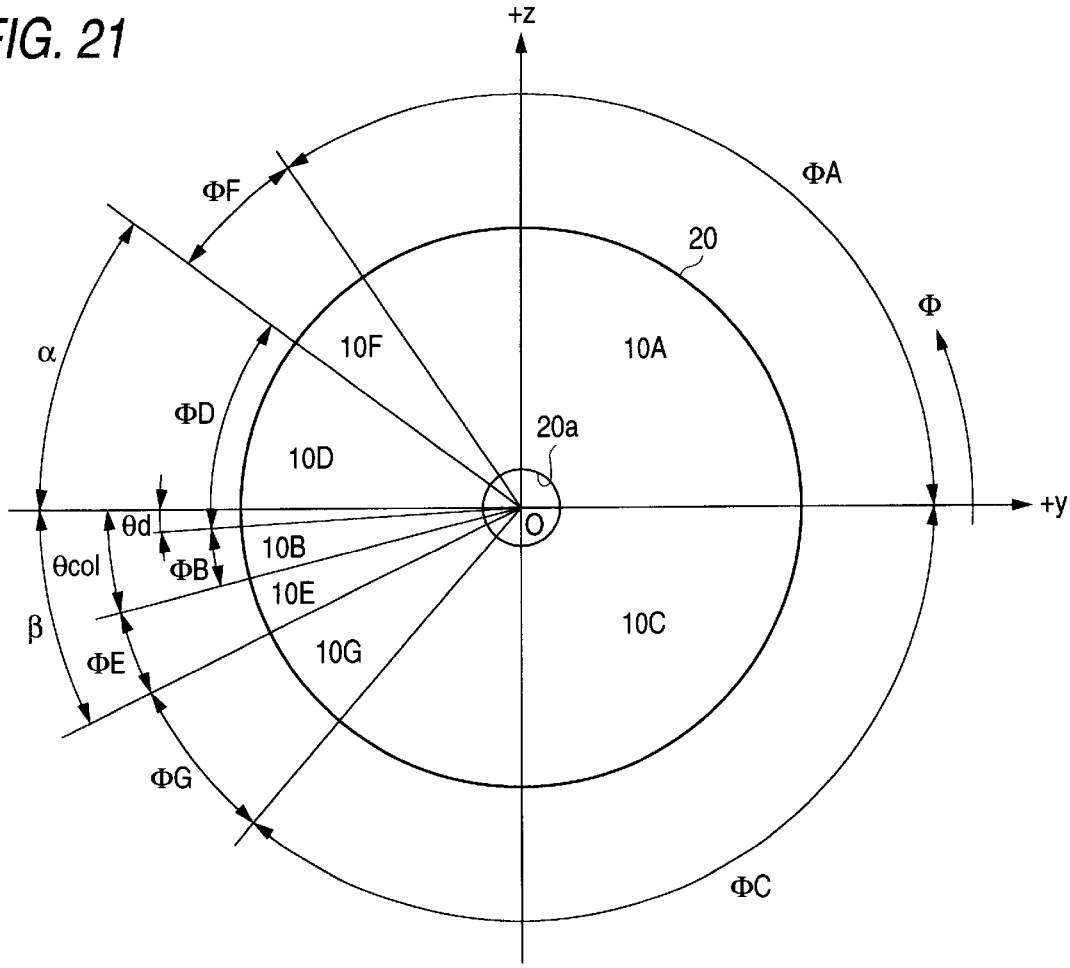
FIG. 21 is a drawing describing, together with FIG. 22, another exemplary configuration of a reflecting face, and is a front view of the reflecting face.

A reflecting face 20, having a light source placement hole 20*a* as shown in FIG. 21, additionally has a new reflecting area 10G which is provided between the reflecting areas 10E and 10C. That is, reflecting areas 10A, 10F, 10D, 10B, 10E, 10G and 10C are placed in order in a counterclockwise direction from the positive y axis. Further, a reference curve is set in a plane inclined at an angle of θG ($0<\theta G\leqq\theta col$) with the horizontal reference face (x-y plane), with the x axis as a rotation axis. The parabolas associated with points on the reference curve are contained in planes orthogonal to the slant reference plane.

Figure 22:
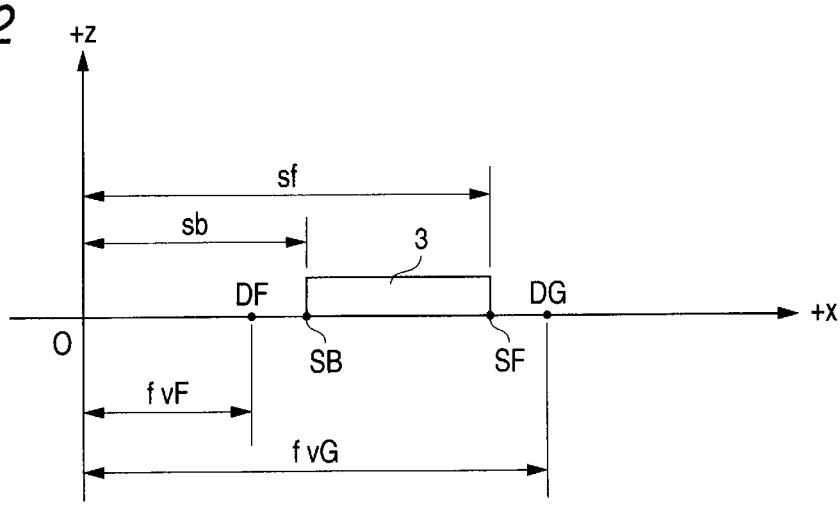
FIG. 22 is a side view describing how to set reference points.

A reference point DG, of the reflecting area 10G, is set at the point SF or ahead the point SF, as shown in FIG. 22. That is, if the distance from the origin point O to the reference point DG is described as fvG, then $sf\leqq fvG$.

For example, if the angle value of θG is set to about 10°, and the value of θE is set to about 15°, the application patterns provided by the reflecting areas contribute to application of light from the medium-distance region to the long-distance region on the lane of the vehicle containing the head lamp.

Figure 23:
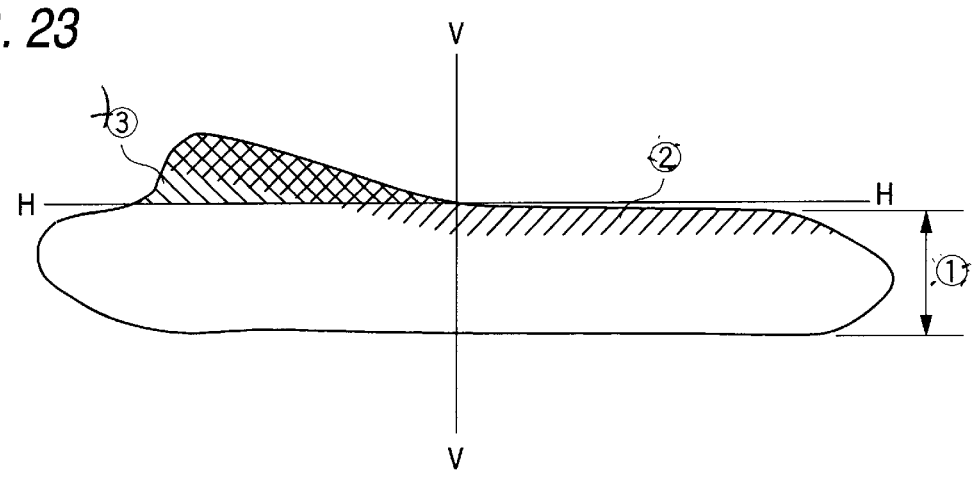
FIG. 23 is a drawing concerning adjustment of light distribution spread.

The number of areas, like the areas 10F and 10G as described above, is increased and a large number of reflecting areas form a reflecting face, whereby it is possible to perform finer light distribution control. That is, if the method is generalized, the reflecting face can be formed according to a combination of an infinite number of reflecting areas {Xi} where i is an integer variable and Xi is A to G, H, . . . , and it is thus possible to adjust the light distribution spread as described below (see FIG. 23 wherein a line H—H denotes a horizontal line) by setting the setup angle related to each area "θXi" and by setting the reference point position "fvXi." Thus:

(1) The degree of diffusion in the up and down direction of the application pattern can be adjusted by varying fvXi;

(2) The amount of light gathered just below cutoff line can be adjusted by varying fvXi; and (3) The light distribution spread in the proximity of the slant cutoff line can be adjusted by varying θXi.

Next, the form (II) will be discussed. Form (II) is one in which a projection pattern is formed just below the slant cutoff line without placing a rotation symmetrical face in near the horizontal reference face containing the optical axis.

Figure 24:
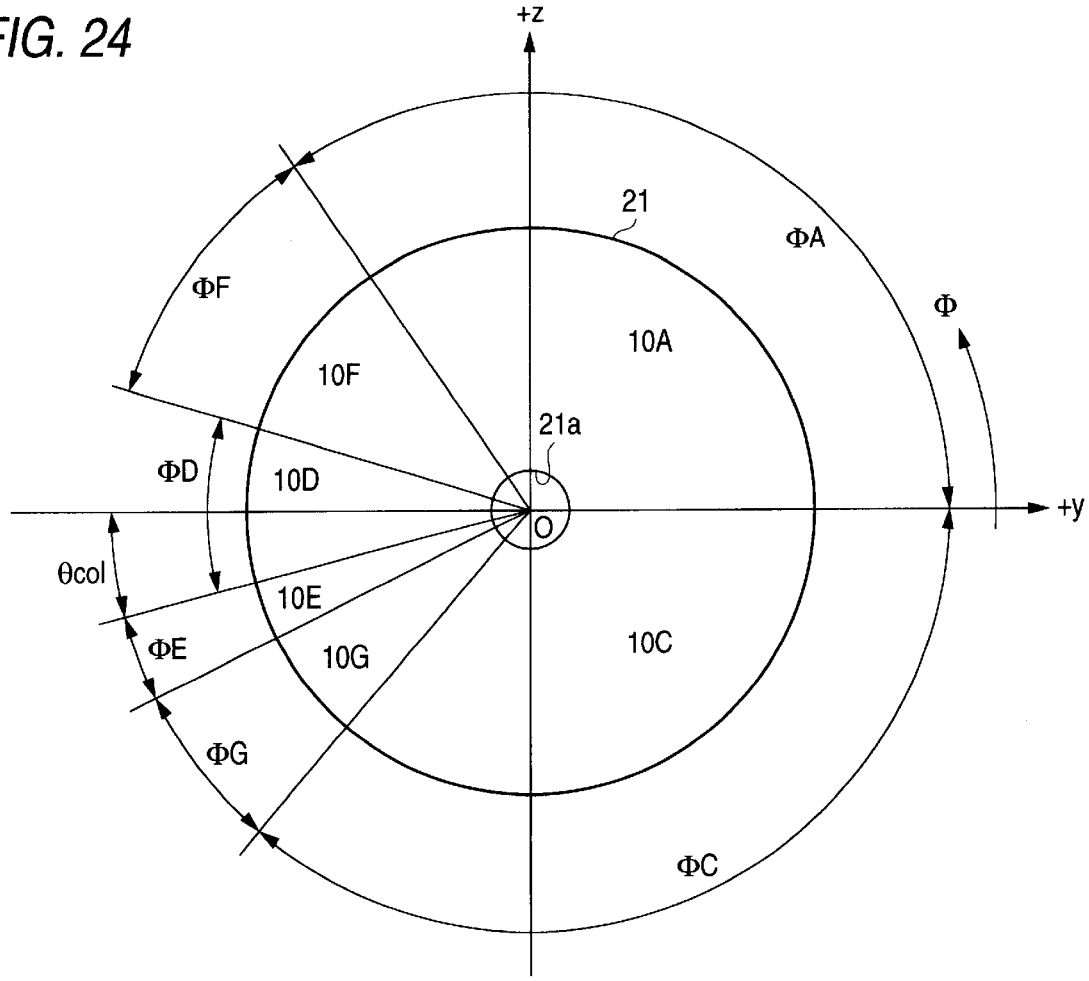
FIG. 24 is a front view showing an exemplary configuration of a reflecting face with area 10B removed.

FIG. 24 shows an exemplary configuration of a reflecting face 21 according to form (II) and having a light source placement hole 21*a*. As seen by comparison with that in FIG. 21, the reflecting area 10B is eliminated. That is, when a reflecting area 10D is viewed from the front, the area 10D is positioned between areas 10F and 10E across the second and third quadrants of the y-z plane. Thus, to clear a slant cutoff line, for example, the following are set:

θD=15° is set;

the angle which the slant face containing the boundary line between the areas 10D, 10E and the x axis forms with the x-y plane is set to 15°; and fvA, fvF, and fvD are set to sb or less and fvE, fvG and fvC are set to sf or more.

In this case, θ1=θD and θ2=θF, θE, or θG.

Form (III) is one in which a projection pattern is formed just below the slant cutoff line by the reflecting area positioned at the right as viewed from a position facing the reflecting face.

In the form (III), the former form of providing applied light to the proximity of the slant cutoff line by the areas positioned at the left of the x-z plane (the second and third quadrants of the y-z plane viewed from the optical axis direction) is changed to the form of providing applied light to the proximity of the slant cutoff line by the areas positioned at the right of the x-z plane (the first and fourth quadrants of the y-z plane viewed from the optical axis direction). The advantage of adopting the form (III) is as follows. For example, when another lamp—such as a turn signal lamp—needs to be added to the left of a lamp such as a head lamp (assuming that a sufficient placement space exists at the right of the lamp), or with an oddly shaped lamp which is not symmetrical, or the like, there may not be sufficient area for the left half of the reflecting face or there may not be a sufficient solid angle between the left half of the reflecting face and the light source body. But form (III) makes it possible to provide sufficient applied light near the slant cutoff line.

Figure 25:
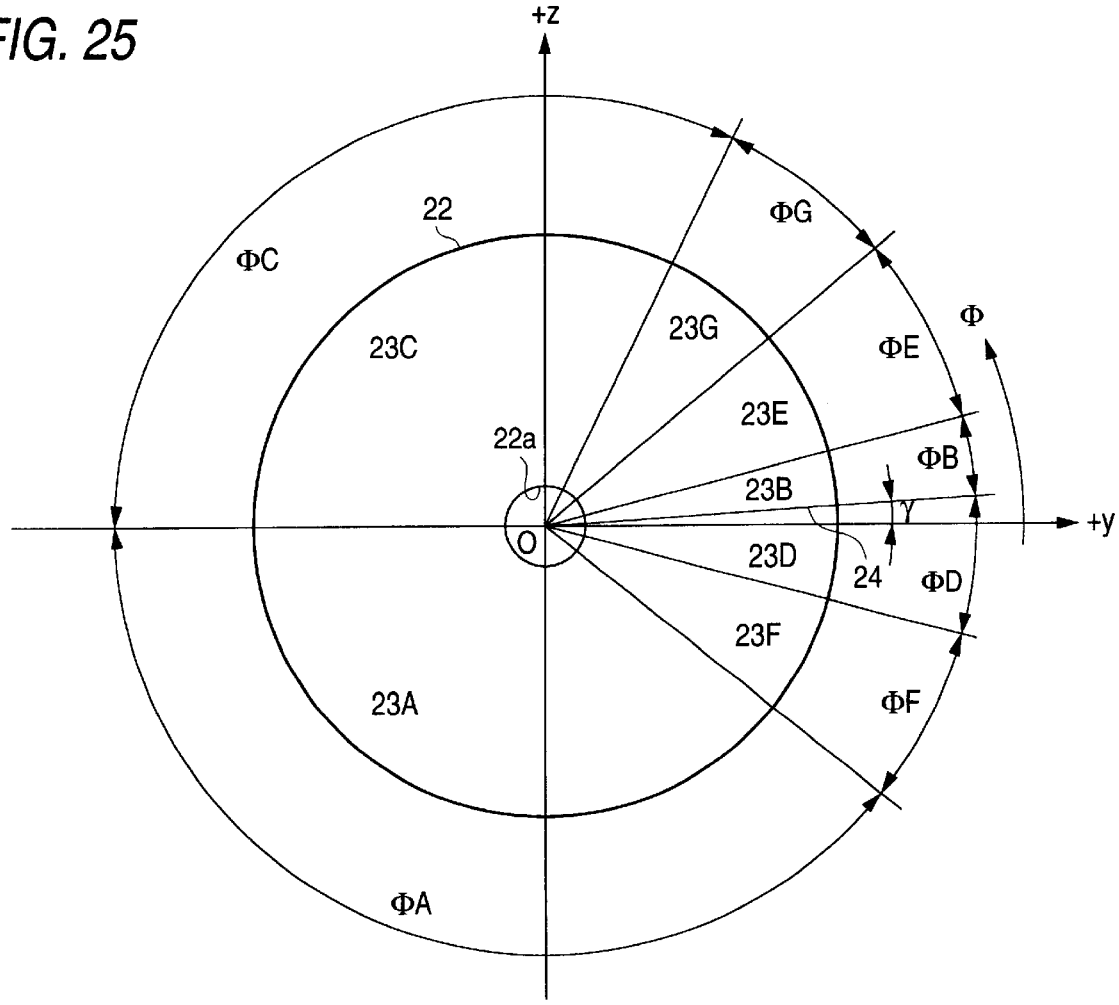
FIG. 25 is a drawing showing, together with FIG. 26, an exemplary configuration of a reflecting face where a slant cutoff line is formed in areas positioned on the right half face and is a front view of the reflecting face.

FIG. 25 shows an exemplary configuration of a reflecting face 22 according to form (III) and having a light source placement hole 22*a*. When the angle axis Φ, having the counterclockwise direction in the figure as the positive direction around the x axis with the positive y axis as the reference of 0°, is set and the occupation angle of each area is set to ΦX (X=A to G), the areas occupy the following ranges:

Reflecting area 23A ($-180° \leqq \Phi < -180° + \Phi A$);

Reflecting area 23F ($-180° + \Phi A \leqq \Phi < -180° + \Phi A + \Phi F$);

Reflecting area 23D ($-180° + \Phi A + \Phi F \leqq \Phi < \gamma$);

Reflecting area 23B ($\gamma \leqq \Phi \leqq \gamma + \Phi B$);

Reflecting area 23E ($\gamma + \Phi B \leqq \Phi < \gamma + \Phi B + \Phi E$);

Reflecting area 23G ($\gamma + \Phi B + \Phi E \leqq \Phi < 180° - \Phi C$); and Reflecting area 23C ($180° - \Phi C \leqq \Phi < 180°$).

The angle γd ($0° < \gamma \leqq \theta col$) is defined as the angle which a boundary line 24, between the areas 23B and 23D, (or a plane containing the boundary line and extended in the x axis direction) forms with the x-y plane (the positive y axis).

The areas positioned in the fourth quadrant of the y-z plane, viewed from the front, are placed in the order of 23A, 23F, and 23D along the counterclockwise direction in the figure, wherein the area 23D is spread over the fourth and first quadrants.

Figure 26:
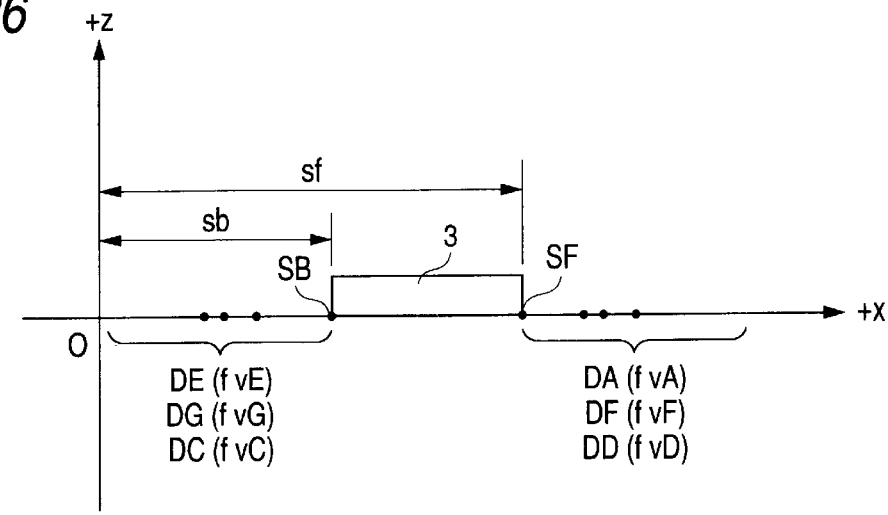
FIG. 26 is a side view describing how to set reference points.

The setup angles of the reference plane are set to "θA=0°" for the area 23A, in the range of $0° < \theta F \leqq \theta col$ for the area 23F, and in the range of $0° < \theta D \leqq \theta col$) for the area 23D. To set reference points, the distances fvA, fvF, and fvD are set to sf or more (see FIG. 26).

The areas positioned in the first quadrant are placed in the order of 23D, 23B, 23E, 23G, and 23C along the counterclockwise direction in the figure.

The shape of the area 23B is a rotationally symmetrical face with the x axis as the axis of rotation, and its focus position is set to point SB or in the proximity of the point SB, for example.

The setup angles of the reference planes for the areas 23E, 23G, and 23C are set in the range of $0° < \theta E \leqq \theta col$ for the area 23E, in the range of $0° < \theta G \leqq \theta col$ for the area 23G, and to "θC=0+" for the area 23C. To set reference points, the distances fvE, fvG, and fvC are set to sb or less (see FIG. 26).

The occupation angles of the areas are defined in the following ranges:

$90° \leqq \Phi A < 180°$ $150° \leqq \Phi F < 105°$ $0° \leqq \Phi D < 15°$ $0° \leqq \Phi B < 15°$ $0° \leqq \Phi E < 75°$ $0° \leqq \Phi G < 75°$ $90° \leqq \Phi C < 165°$ As in the above-described example, the configuration may include another area, or areas, inserted between the areas 23A and 23F, whereby the number of reflecting areas can be increased innumerably at the right of the reflecting face.

Form (IV) is one in which a projection pattern is formed just below the slant cutoff line by using the reflecting areas positioned at both the left and right of the reflecting face, and near the horizontal reference face containing the optical axis.

In the form (IV), areas positioned near to the x-y plane, and also positioned at the left and the right of the x-z plane, are used together, whereby applied light is provided in the proximity of a slant cutoff line. The form (IV) is useful for the case where only one side area of the reflecting face cannot provide sufficient light to clearly form a slant cutoff line because the lateral width of a lamp (the width in the y axis direction) is narrow, for example.

Figure 27:
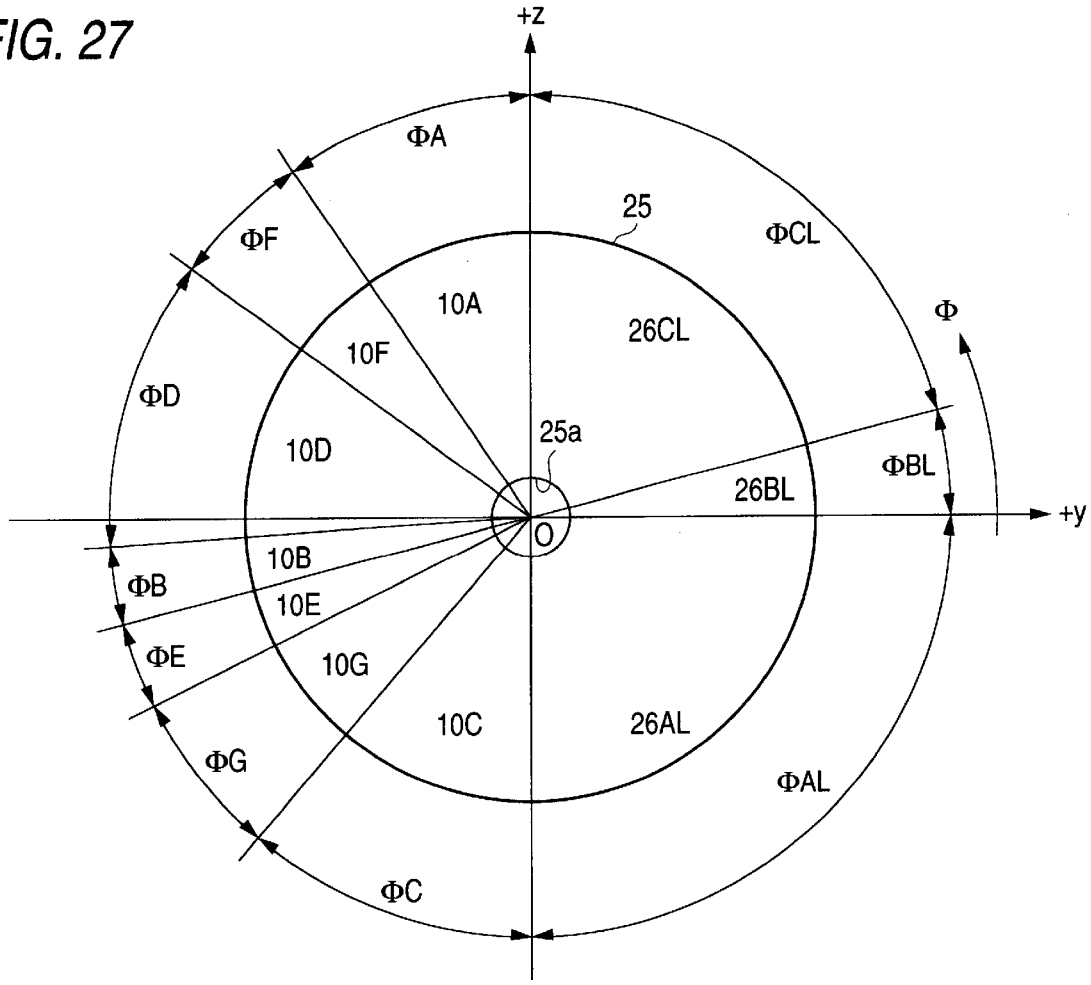
FIG. 27 is a drawing showing, together with FIG. 28, an exemplary configuration of a reflecting face wherein a slant cutoff line is formed using both the areas positioned on the left-half reflecting face and the right-half reflecting face, and is a front view of the reflecting face.

FIG. 27 shows an exemplary configuration of a reflecting face 25 according to form (IV) and having a light source placement hole 25*a*. The configuration of the left half face (the left portion of the x-z plane) is similar to the configuration in the example of FIG. 21.

When the angle axis Φ, having the counterclockwise direction in the figure as the positive direction around the x axis with the positive y axis as the reference of 0°, is set and the occupation angle of each area is set to ΦX (X=A to G, AL, BL, CL), the areas occupy the following ranges:

i) Left half face

Reflecting area 10A ($90° \leqq \Phi < 90° + \Phi A$);

Reflecting area 10F ($90° + \Phi A \leqq \Phi < 90° + \Phi A + \Phi F$);

Reflecting area 10D ($90° + \Phi A + \Phi F \leqq \Phi < 180° + \eta$);

Reflecting area 10B ($180° + \eta \leqq \Phi < 180° + \eta + \Phi B$);

Reflecting area 10E ($180° + \eta + \Phi B \leqq \Phi < 270° - \Phi C - \Phi G$);

Reflecting area 10G ($270° - \Phi C - \Phi G \leqq \Phi < 270° - \Phi C$); and Reflecting area 10C ($270° - \Phi C \leqq \Phi < 270°$).

ii) Right half face

Reflecting area 26AL ($270° \leqq \Phi < 360°$);

Reflecting area 26BL ($0° \leqq \Phi < \Phi BL$); and

Reflecting area 26CL ($\Phi BL \leqq \Phi < 90°$).

The angle η is defined as the angle which the boundary line between the areas 10D and 10B—or the plane containing the boundary line and extended in the x axis direction—forms with the x-y plane (the negative y axis).

Figure 28:
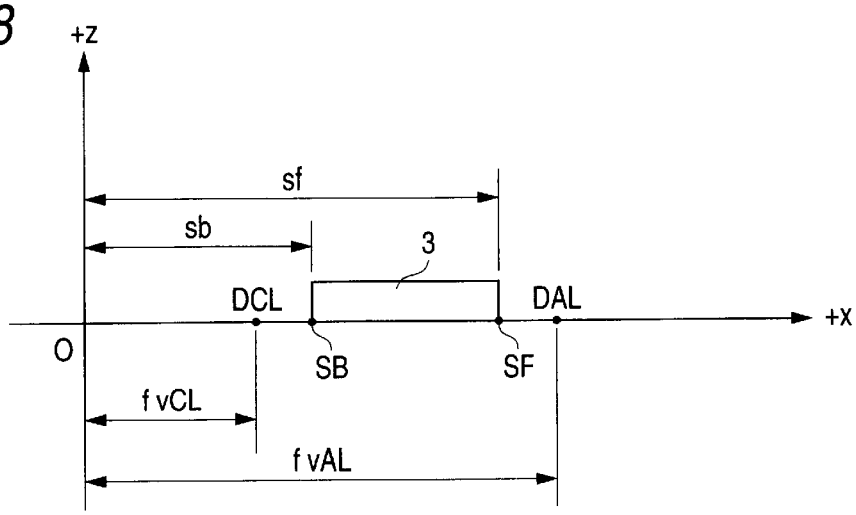
FIG. 28 is a side view describing how to set reference points.

To provide light to the range of a horizontal cutoff line, for the area 26AL, the setup angle of the reference plane is set to "θAL=0°", and for a reference point (DAL) the distance fvAL is set to sf or more (see FIG. 28).

The area 26BL has an occupation area of ΦBL=15° and the shape thereof is a rotationally symmetrical face, with the x axis as an axis of rotation, and its focus is set to point SB or in the proximity of the point SB, for example.

For the area 26CL, the setup angle of the reference plane is set to "θCL=0°", and for a reference point (DCL) the distance fvCL is set to sb or less (see FIG. 28).

In the example, light forming the range positioned just below a slant cutoff line can be provided by the area 26BL which is close to the x-y plane in the right half face, and by the areas 10B, 10D, 10E, 10F, and 10G.

Figure 29:
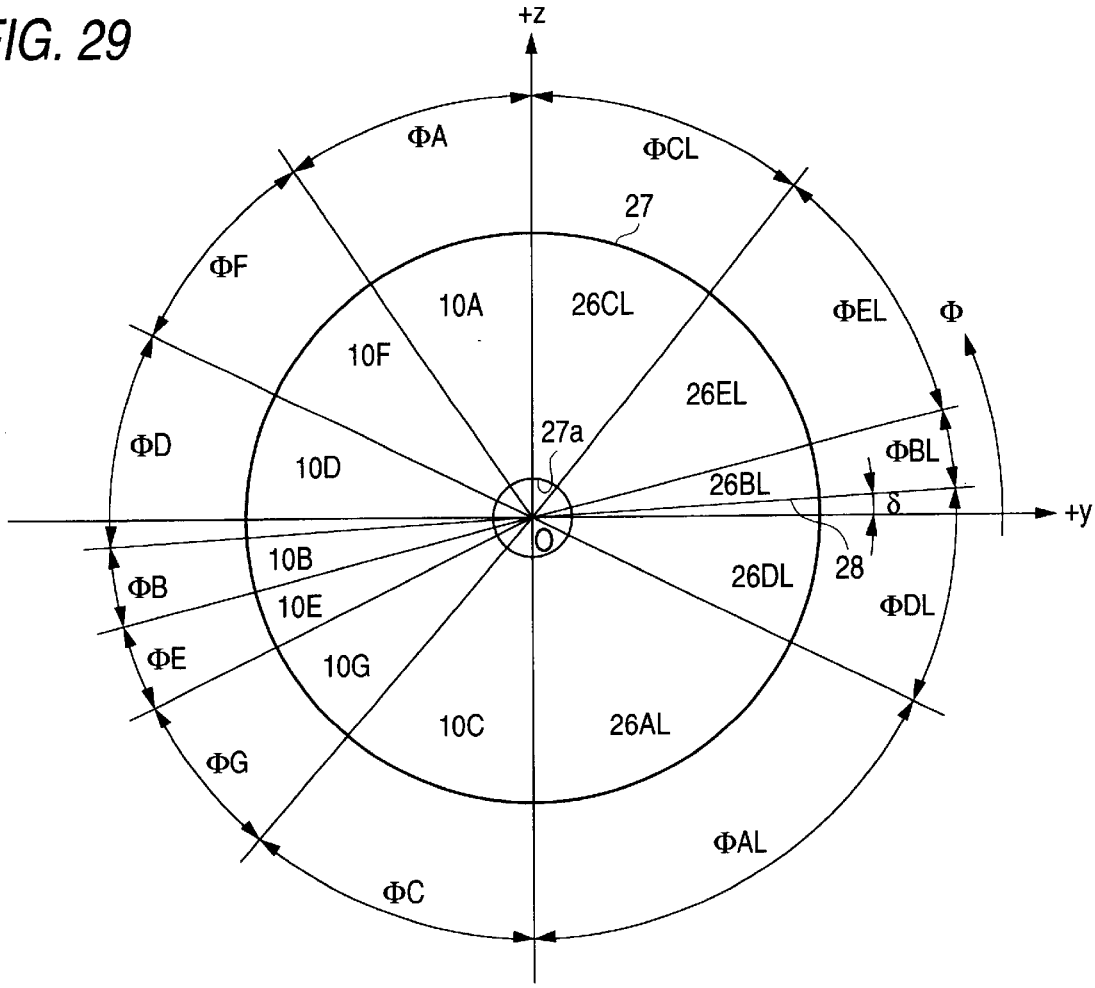
FIG. 29 is a drawing showing, together with FIG. 30, an exemplary configuration of a reflecting face with an increased number of area partitions on the right half face in the configuration of FIG. 27, and is a front view of the reflecting face.
Figure 31:
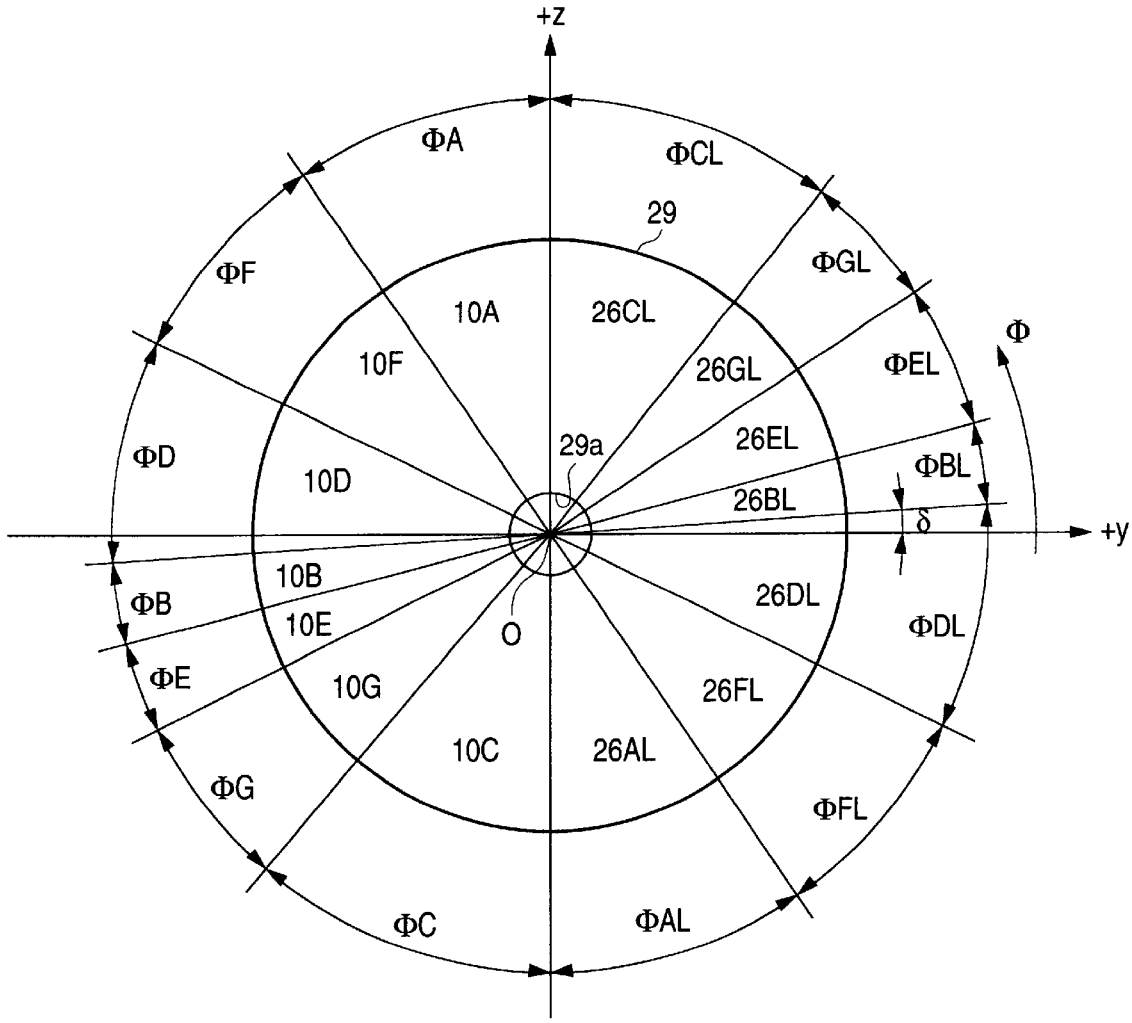
FIG. 31 is a drawing showing an exemplary configuration of a reflecting face with a larger number of area partitions on the right half face than in the configuration in FIG. 29, and is a front view of the reflecting face.

The right half of the reflecting face can be divided more finely; for example, configurations shown in FIGS. 29 and 31 can be formed.

In the example in FIG. 29, the left half of a reflecting face 27, according to form (IV), has a light source placement hole 27a and has the same configuration as that in the example of FIG. 27. The right half of the reflecting face has the following reflecting areas:

Reflecting area 26AL ($270° \leqq \Phi < 270° + \Phi AL$);

Reflecting area 26DL ($270° + \Phi AL \leqq \Phi < \delta$);

Reflecting area 26BL ($\delta \leqq \Phi < \delta + \Phi BL$);

Reflecting area 26EL ($\delta + \Phi BL \leqq \Phi < \delta + \Phi BL + \Phi EL$); and Reflecting area 26CL ($90° - \Phi CL \leqq \Phi < 90°$).

The angle $\delta$ is defined as the angle which a boundary line 28 between the areas 26DL and 26BL—or a plane containing the boundary line and extended in the x axis direction—forms the x-y plane (the negative axis of y).

The areas 26AL, 26BL, and 26CL are set as described above. For the area 26DL, the setup angle related to the reference plane $\theta DL$ is set in the range of $0° < \theta DL \leqq \theta col$, and for a reference point (DDL), the distance fvDL is set to sf or more (see FIG. 30).

Figure 30:
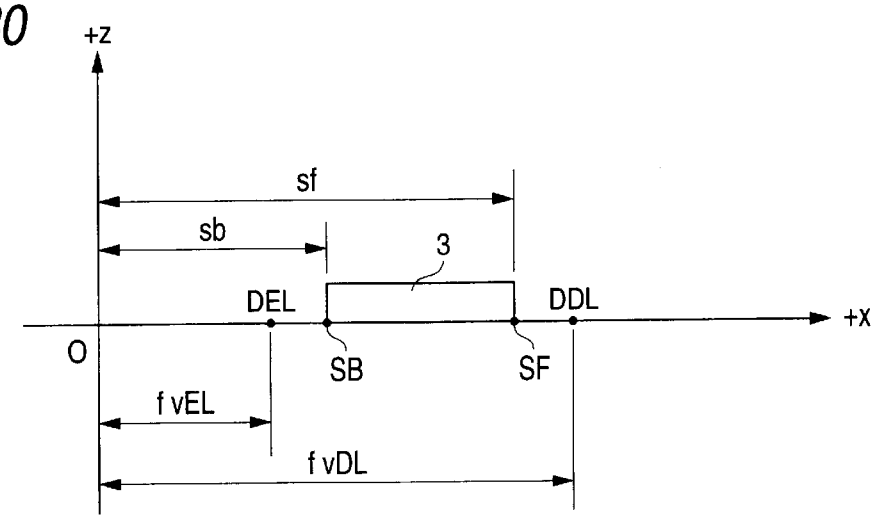
FIG. 30 is a side view describing how to set reference points.

For the area 26EL, the setup angle related to the reference plane $\theta EL$ is set in the range of $0° < \theta EL \leqq \theta col$, and for a reference point (DEL), the distance fvEL is set to sb or less (see FIG. 30).

In this example, light forming the range positioned just below a slant cutoff line can be provided by the area 26BL, and by the areas 26DL and 26EL, which are positioned on both sides of the area 26BL in the right half face of the reflecting face 27.

FIG. 31 shows a configuration of a reflecting face 29, having a light source placement hole 29*a*, wherein a new area 26FL is provided between areas 26DL and 26AL, and wherein a new area 26GL is provided between areas 26EL and 26CL. The right half face thus includes the following reflecting areas:

Reflecting area 26AL ($270° \leqq \Phi < 270° + \Phi AL$);

Reflecting area 26FL ($270° + \Phi AL \leqq \Phi < 270° + \Phi AL + \Phi FL$);

Reflecting area 26DL ($270° + \Phi AL + \Phi FL \leqq \Phi < \delta$);

Reflecting area 26BL ($\delta \leqq \Phi < \delta + \Phi BL$);

Reflecting area 26EL ($\delta + \Phi BL \leqq \Phi < \delta + \Phi BL + \Phi EL$);

Reflecting area 26GL ($\delta + \Phi BL + \Phi EL \leqq \Phi < \delta + \Phi BL + \Phi EL + \Phi GL$); and Reflecting area 26CL ($90° - \Phi CL \leqq \Phi < 90°$).

In this example, for the area 26FL, the setup angle related to the reference plane $\theta FL$ is set in the range of $0° < \theta FL \leqq \theta col$, and for a reference point (DFL) the distance fvFL is set to sf or more. For the area 26GL, the setup angle related to the reference plane $\theta GL$ is set in the range of $0° < \theta GL \leqq \theta col$, and for a reference point (DGL) the distance fvGL is set to sb or less.

Thus, light forming the range positioned just below a slant cutoff line can be provided by the areas 26BL, 26DL, 26EL, 26FL, and 26GL in the right half face of the reflecting face 29.

Therefore, a large number of reflecting areas are inserted between the reflecting areas 26AL and 26BL, and between the areas 26BL and 26CL, thereby increasing the number of reflecting areas, so that it is possible to design a more detailed light distribution.

Next, the form (V) will be discussed. Form (V) is one in which a projection pattern is formed just below the horizontal cutoff line by the reflecting area positioned at the right as viewed from a position facing the reflecting face.

In the form (V), light provided by the areas positioned in the right half of a reflecting face does not contribute to the amount of light spread near a slant cutoff line. But the right half face is partitioned into areas, and the focus position of a parabola is changed in a longitudinal direction (a direction orthogonal to the reference plane) for each area, whereby light can be gathered just below a horizontal cutoff line.

Figure 32:
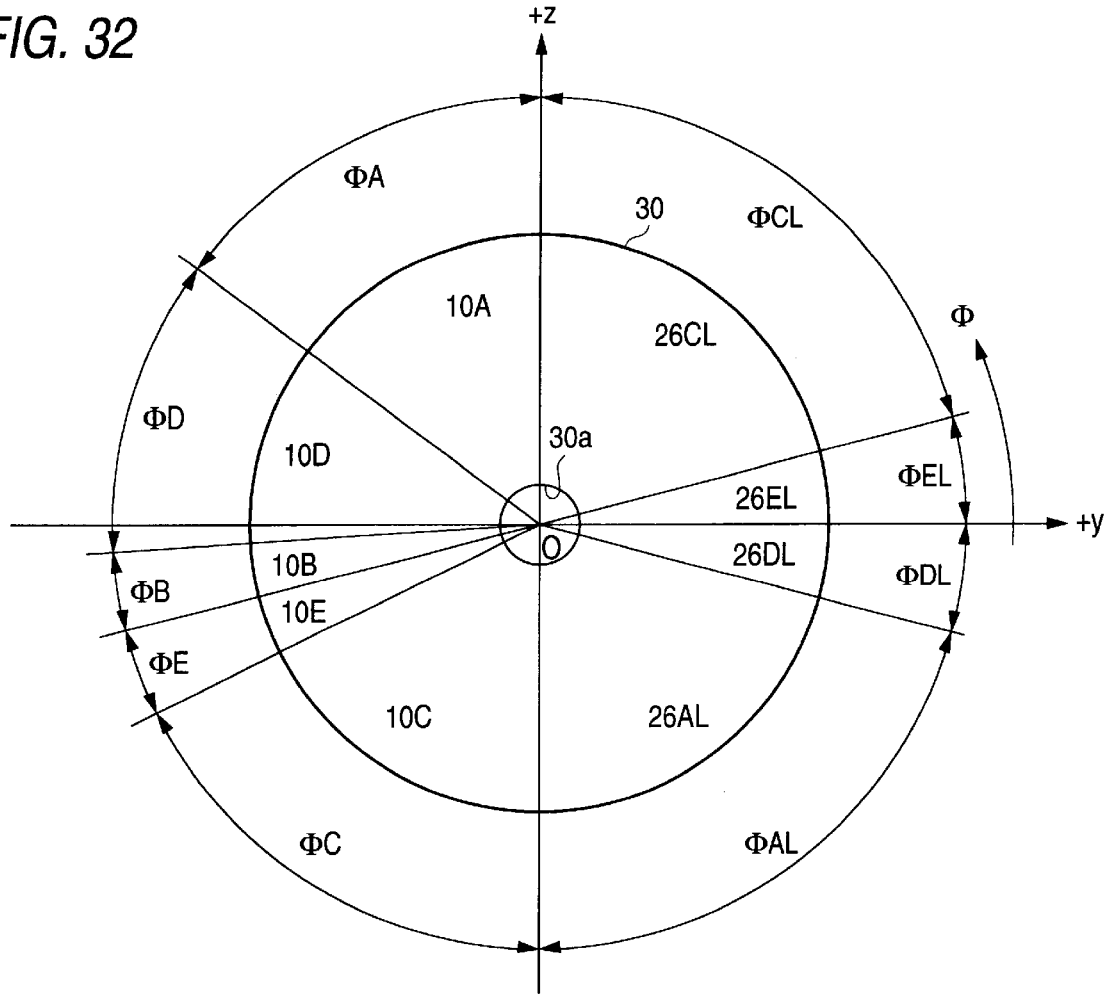
FIG. 32 is a front view showing an exemplary configuration of a reflecting face where light can be gathered just below a horizontal cutoff line using the areas positioned on the right half of the reflecting face.

FIG. 32 shows an exemplary configuration of such a reflecting face. The configuration of the left half of a reflecting face 30, having a light source placement hole 30*a*, is similar to the configuration in the example of FIG. 11. That is, areas 10A, 10D, 10B, 10E, and 10C are placed in order in a counterclockwise direction from the positive z axis. The right half of the reflecting face 30 has the following reflecting areas:

Reflecting area 26AL ($270° \leqq \Phi < 270° + \Phi AL$);

Reflecting area 26DL ($270° + \Phi AL \leqq \Phi < 0°$);

Reflecting area 26EL ($0° \leqq \Phi < \Phi EL$); and

Reflecting area 26CL ($\Phi EL \leqq \Phi < 90°$).

First, for the area 26AL, the setup angle of the reference plane is set to "$\theta AL = 0°$", and fvAL is set larger than sf to prevent a filament image from extending off above a horizontal cutoff line.

For the area 26DL, the setup angle of the reference plane is set to "$\theta DL = 0°$", and fvDL is set equal to sf to improve distance visibility by gathering a filament image just below a horizontal cutoff line.

For the area 26EL, the setup angle of the reference plane is set to "$\theta EL = 0°$", and fvEL is set equal to sb.

If the reference point for the area 26DL is set at the front end position of the filament, and the reference point for the area 26EL is set at the rear end position of the filament, the advantage of improving forward visibility on the opposite lane is provided.

For the area 26CL, the setup angle of the reference plane is set to "$\theta CL = 0°$", and fvCL is set shorter than sb.

Form (VI)is one which avoids too much enhancement of the slant cutoff line.

The form (VI) is used to prevent a slant cutoff line from being cleared more than necessary, and to prevent the detrimental effects caused by too much enhancement of the range just below the slant cutoff line. For example, there are risks that light may be applied only into the air, that reflected light on a wall or other object may interfere with driving the vehicle, or that another road user may be inconvenienced by the light from the head lamp. Particularly, when using a high-intensity discharge lamp, such as a metal halide lamp, consideration is required.

Giving a description using the same example as the configuration in FIG. 11, the configuration of a reflecting face is characterized by the following settings:

a) $0° < \Phi B + \theta d < 15°$; and b) for any one or more of areas 10D, 10E, 10F, and 10G, the setup angle of the reference plane $\theta X$ is set to 15° (for example, $\theta D$ is set equal to 15°).

First, the condition in a) is a condition for preventing a filament image, provided by area 10B, from unnecessarily being gathered just below a slant cutoff line.

The setting in b) is required for providing light directed just below the slant cutoff line by at least one of the areas 10D, 10E, 10F, and 10G. That is, for each area, the setup angle of the reference plane is defined in the range of $0° < \theta X \leqq 15°$ (X=D, E, F, G). And any one or more of them ($\theta X$) is set so as to have an angle equal to 15°.

Additionally, it is possible to increase or decrease the number of reflecting areas, and it is also possible to configure the reflecting faces as previously described in (III) and (IV).

2. Embodiments

FIGS. 33 to 36 show one embodiment of a reflecting mirror, for an automobile head lamp, incorporating the invention. In this embodiment, the above-described basic face is applied to a reflecting face of a reflecting mirror whose front is shaped almost like a landscape rectangle.

Figure 33:
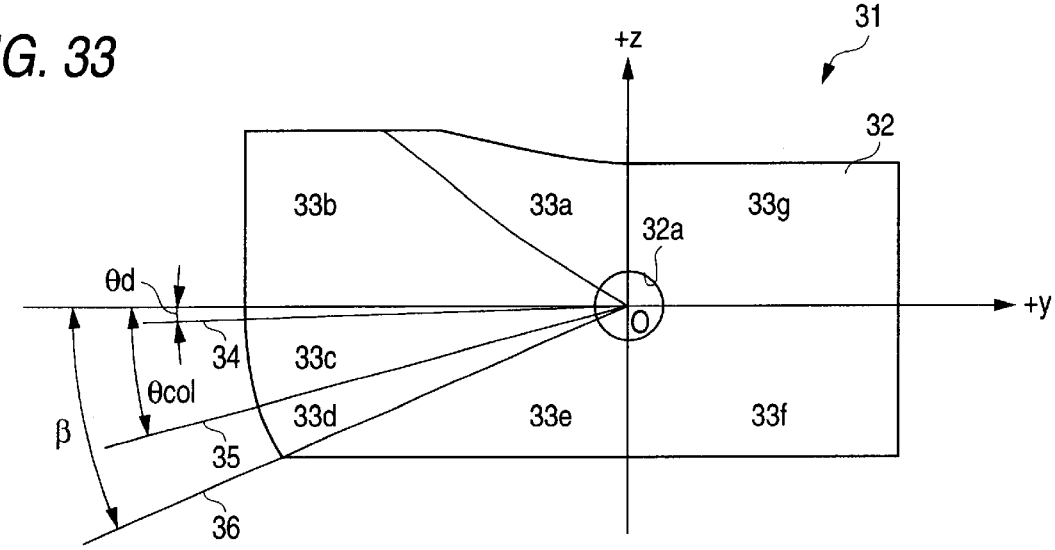
FIG. 33 shows, together with FIGS. 34 to 36, one embodiment according to the inventions and is a front view of a reflecting face.

FIG. 33 is a front view showing a reflecting face 32 of a reflecting mirror 31. A rectangular coordinate system is set so as to have the optical axis extending perpendicularly to the paper face as an x axis (the front side is assumed to be the positive direction), the horizontal axis orthogonal to the x axis as a y axis (the right of the figure is assumed to be the positive direction), and the vertical axis as a z axis (the top of the figure is assumed to be the positive direction), wherein an intersection point O of the three axes is an origin point.

The reflecting face 32 is formed with a circular hole 32*a*, having the origin point O as the center when viewed from the front, as an electric bulb insertion hole. A filament of a light source body is placed in the reflecting mirror 31 through the circular hole 32*a*.

The reflecting face 32 is made up of the following seven reflecting areas 33*a* to 33*g*:

reflecting area 33*a* (area close to and at the left of the x-z plane and shaped almost like a triangle);

reflecting area 33*b* (area adjoining the left of the area 33*a* and shaped almost like a trapezoid);

reflecting area 33*c* (fan-shaped area adjoining the area 33*b* below the x-y plane);

reflecting area 33*d* (fan-shaped area adjoining the bottom of the area 33*c*);

reflecting area 33*e* (almost triangular area positioned at the left of the x-z plane and adjoining the area 33*d*);

reflecting area 33*f* (almost rectangular area positioned at the right of the x-z plane below the x-y plane); and reflecting area 33*g* (almost rectangular area positioned at the right of the x-z plane above the x-y plane).

The areas 33*a–g* correspond to the area partitions shown in FIG. 11 as follows: the areas 33*a* and 33*g* correspond to the above-mentioned area 10A; the area 33*b* corresponds to the above-mentioned area 10D; the area 33*c* corresponds to the above-mentioned area 10B; the area 33*d* corresponds to the above-mentioned area 10E; and the areas 33*e* and 33*f* correspond to the above-mentioned area 10C. In FIG. 33, line 34 represents the boundary between the areas 33*b* and 33*c* (inclination angle to x-y plane=θd), a line 35 represents the boundary between the areas 33*c* and 33*d* (inclination angle to x-y plane=θcol), and a line 36 represents the boundary between the areas 33*d* and 33*e* (inclination angle to x-y plane=β).

The roles of the reflecting areas are as follows. The areas 33*a* and 33*e* are involved in forming diffused light spread in the horizontal direction, whereas the area 33*b* is involved in forming diffused light along a direction inclined at an angle of θd (=2°) below a 15-degree slant cutoff line. The area 33*c* contributes to light formed in the range positioned just below the 15-degree slant cutoff line, whereas the area 33*d* is required for increasing the applied light amount to that range. The areas 33*f* and 33*g* are involved in forming a clear horizontal cutoff line (on the opposite lane) and forming diffused light in the horizontal direction.

Figure 34:
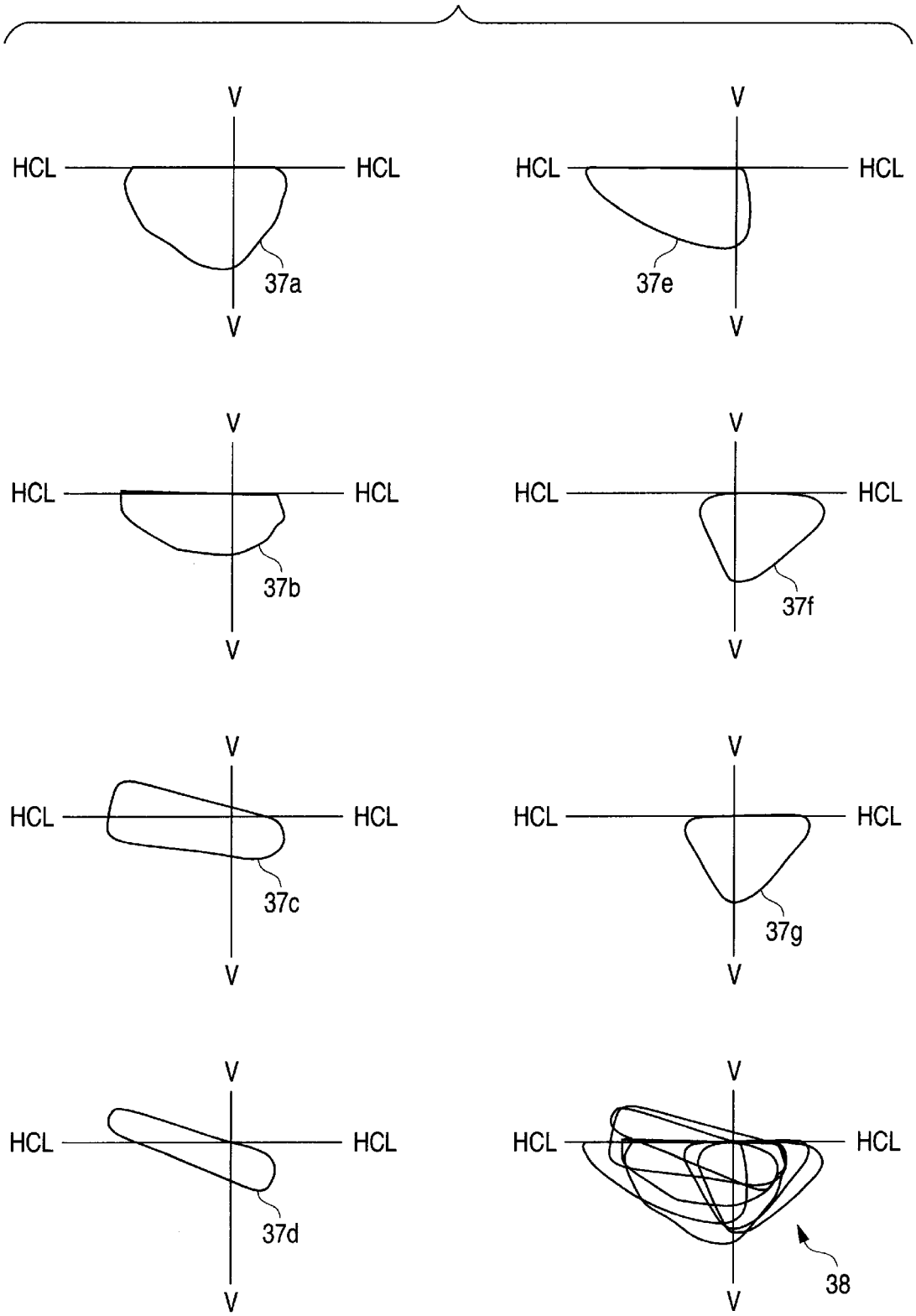
FIG. 34 is a drawing schematically showing projection patterns provided by reflecting areas when a downward beam is applied.

FIG. 34 is a drawing schematically showing a distribution of application patterns projected by the reflecting areas on a screen placed in front of the reflecting face 32. In the figure, the HCL—HCL line and the V—V line are as previously described.

An application pattern 37*a* denotes a pattern provided by the reflecting area 33*a*. It is positioned below the HCL—HCL line and has an upper margin along the horizontal direction.

An application pattern 37*b* denotes a pattern provided by the reflecting area 33*b* and has an upper margin formed along the direction slanting leftward and upward at an angle of 2° with the HCL—HCL line.

An application pattern 37*c* denotes a pattern provided by the reflecting area 33*c* and has an upper margin formed along the direction slanting leftward and upward with respect to the HCL—HCL line at the slant cutoff line angle (15°).

An application pattern 37*d* denotes a pattern provided by the reflecting area 33*d* and has an upper margin along the direction slanting leftward and upward with respect to the HCL—HCL line at the slant cutoff line angle (15°). That is, the visibility in the left distant region is improved by enhancing light in the area just below the slant cutoff line according to this application pattern.

An application pattern 37*e* denotes a pattern provided by the reflecting area 33*e*. It is positioned below the HCL—HCL line and has an upper margin along the horizontal direction.

The patterns 37*a* to 37*e* occupy an area at the left of the vertical line V—V that is larger than the area occupied at the right of the vertical line V—V, and the trend is recognized noticeably in the pattern 37*e*.

An application pattern 37*f* denotes a pattern provided by the reflecting area 33*f*. It is positioned below the HCL—HCL line and has an upper margin along the horizontal direction.

An application pattern 37*g* denotes a pattern provided by the reflecting area 33*g*. It is positioned below the HCL—HCL line and has an upper margin along the horizontal direction.

The patterns 37*f* and 37*g* occupy an area at the right of the vertical line V—V that is larger than the area occupied at the left of the vertical line V—V An application pattern 38 is provided by overlapping the reflecting patterns 37*a* to 37*g* and the whole application range can be seen to some extent from the application pattern 38.

Figure 35:
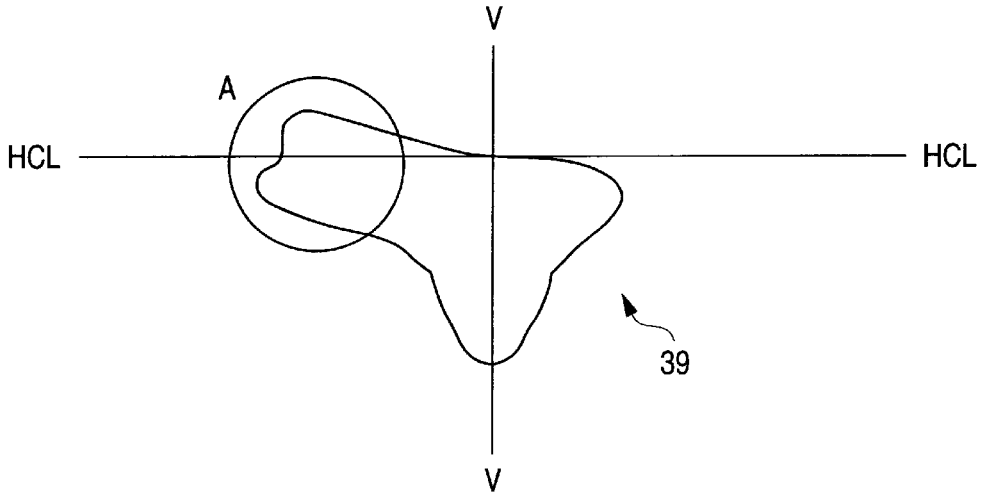
FIG. 35 is a drawing schematically showing an original pattern provided by a reflecting face before undergoing waving processing.

FIG. 35 schematically shows an application pattern 39 provided by a reflecting face before undergoing waving processing. The applied light amount is increased in the range at the left of the vertical line V—V and positioned near the HCL—HCL line (the range in circle A).

Figure 36:
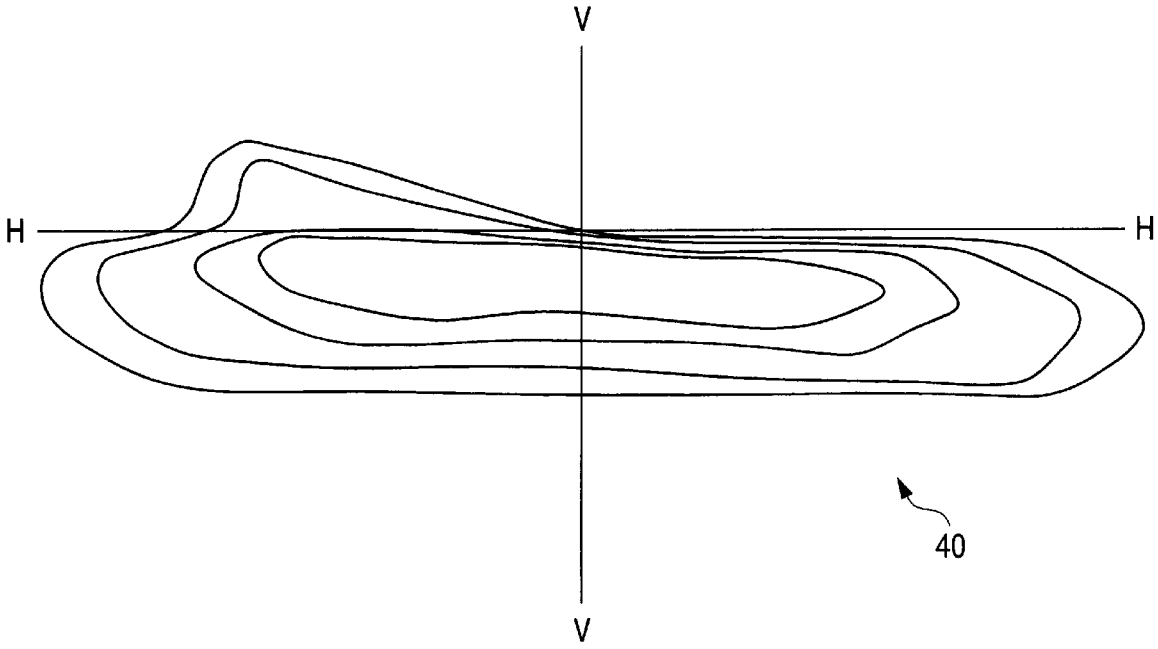
FIG. 36 is a drawing schematically showing a light distribution spread when a downward beam is applied after waving processing.

FIG. 36 schematically shows equal illumination lines about a light distribution pattern of a downward beam provided by a reflecting face after undergoing waving processing (H—H line denotes a horizontal line). The effect of light diffusion produced by waving the application pattern (original pattern) 39 is recognized. The light distribution pattern is provided as a pattern sufficiently satisfying a predetermined light distribution standard by the effect of only the reflecting face 32, so that the front lens may be a plain lens with no lens step, or may be an almost plain lens.

3. Advantages of the Invention

As seen from the description given above, according to first and second aspects of the invention, the projection image of the light source body provided by the first reflecting area is placed along the slant cutoff line Just below the line, whereby a necessary amount of light is provided for forward distance visibility on the lane of the vehicle containing the head lamp. The projection image of the light source body provided by the second reflecting area is placed along a line having an angle smaller than the slant cutoff line, whereby an amount of light can be provided to the medium-distance forward-region on the lane of the vehicle containing the head lamp. Thus, safety for night driving can be enhanced.

According to third and sixth aspects of the invention, the full reflecting face, or a part thereof, is formed like waves based on the function of the product of a normal distribution type function and a periodic function for providing largely diffused light in a predetermined direction, whereby the dependency on the diffusion effect of the front lens can be decreased drastically.

According to fourth and seventh aspects of the invention, the peak value of the normal distribution type function is changed so that the wave height of a wave part becomes lower at a place more distant from the horizontal reference face of the reflecting face containing the optical axis. Thus, light reflected on the area to the upper end part of the reflecting face and the area to the lower end part is not diffused more than necessary.

According to a fifth aspect of the invention, the curved surface shape of each reflecting area can be designed as a set of parabolas associated with the direction orthogonal to the horizontal reference face or the slant reference plane. And placement of the projected image of the light source body contributing to the range just below the slant cutoff line can be controlled in detail by adjusting the setup angle of the reference plane.

It is contemplated that numerous modifications may be made to the method of forming a reflecting mirror for a vehicle headlamp according to the present invention without departing from the spirit and scope of the invention as defined in the following claims.

What is claimed is:

1. A vehicle head lamp comprising:

a light source body; and a reflecting mirror having areas of a reflecting face defined by:

(a) a reference curve which, for various reflecting face portions, is either set in a horizontal reference plane containing an optical axis, or set in a slant reference plane inclined at a predetermined angle with respect to the horizontal reference face and using the optical axis as an axis of rotation;

(b) said light source body, having a center axis extending along the optical axis, placed in the proximity of a reference point of the reference curve; and (c) a reflecting face formed as a set of cross lines provided by cutting a virtual paraboloid of revolution having an axis parallel with a light beam vector of reflected light when light assumed to be emitted from the reference point of the reference curve positioned on the optical axis is reflected at an arbitrary point on the reference curve, wherein the paraboloid passes through the reflection point, and has the reference point as a focus, and wherein said paraboloid of revolution is cut on a virtual plane containing the light beam vector and parallel with a plane orthogonal with or inclined to either the horizontal reference or the slant reference plane;

wherein the basic face provides a light distribution pattern of a downward beam having a slant cutoff line inclined with respect to a horizontal line, further wherein for a reflecting-face first reflecting area, close to the horizontal reference plane when the reflecting face is viewed from the optical axis direction, a reference curve is set in a slant reference plane inclined to the horizontal reference plane at a first angle equal to an angle of the slant cutoff line with the horizontal line, and further wherein for a reflecting-face second reflecting area, positioned above or below the first reflecting area with respect to the horizontal reference plane when the reflecting face is viewed from the optical axis direction, a second reference curve is set in a second slant reference plane inclined to the horizontal reference plane at a second angle larger than 0° and smaller than the angle of the slant cutoff line with the horizontal line.

2. The vehicle head lamp as claimed in claim 1, wherein an image of the light source body projected forward by the first reflecting area is placed just below the slant cutoff line in a light distribution pattern along the slant cutoff line, and another image of the light source body projected forward by the second reflecting area is placed just below a line formed at the second angle with the horizontal line along that line.

3. The vehicle head lamp as claimed in claim 2, wherein the full reflecting face, or a part thereof, is formed with waves by performing an addition operation on an expression of the reflecting face based on a function of a product of a normal distribution function and a periodic function.

4. The vehicle head lamp as claimed in claim 3, wherein the height of the waves is made lower at a place more distant from the horizontal reference face of the reflecting face containing the optical axis.

5. The vehicle head lamp as claimed in claim 1, wherein the full reflecting face, or a part thereof, is formed with waves by performing an addition operation on an expression of the reflecting face based on a function of a product of a normal distribution function and a periodic function.

6. The vehicle head lamp as claimed in claim 5, wherein the height of the waves is made lower at a place more distant from the horizontal reference face of the reflecting face containing the optical axis.

7. A method of forming a reflecting mirror for a vehicle head lamp, comprising the steps of:

(a) setting as a reference curve a curve in a horizontal reference plane containing an optical axis, or a curve in a slant reference plane, wherein an optical axis is used as an axis of rotation; then (b) setting a light source body so that a center axis of the light source body extends along the optical axis, and so that the light source body is placed in the proximity of a reference point of the reference curve; and (c) generating a cross line set provided by cutting a virtual paraboloid of revolution having an axis parallel with a light beam vector of reflected light when light assumed to be emitted from the reference point of the reference curve positioned on the optical axis is reflected at an arbitrary point on the reference curve, wherein the paraboloid passes through the reflection point, and has the reference point as a focus, and wherein said paraboloid of revolution is cut on a virtual plane containing the light beam vector and parallel with a plane orthogonal with or inclined to either the horizontal reference or the slant reference face, thereby forming a reflecting face;

wherein the above three steps are satisfied to form a basic face which provides a light distribution pattern of a downward beam having a slant cutoff line inclined with respect to a horizontal line, further wherein for a first reflecting area, close to the horizontal reference plane when the reflecting face is viewed from the optical axis direction, a reference curve is set in a slant reference plane inclined to the horizontal reference plane at a first angle equal to an angle of the slant cutoff line with the horizontal line, in order to generate a cross line set, and further wherein for a second reflecting area, positioned above or below the first reflecting area with respect to the horizontal reference plane when the reflecting face is viewed from the optical axis direction, a second reference curve is set in a second slant reference plane inclined to the horizontal reference plane at a second angle larger than 0° and smaller than the angle of the slant cutoff line with the horizontal line in order to generate a second cross line set.

8. The method of forming a reflecting mirror of a vehicle head lamp as claimed in claim 7, further comprising forming the full reflecting face, or a part thereof, with waves by performing an addition operation on an expression of the reflecting face based on a function of a product of a normal distribution function and a periodic function.

9. The method of forming a reflecting mirror of a vehicle head lamp as claimed in claim 8, further comprising changing a peak value of the normal distribution function so that the height of the waves becomes lower at a place more distant from the horizontal reference face of the reflecting face containing the optical axis.

10. A vehicle head lamp comprising:

a light source body disposed along an optical axis of said vehicle head lamp; and a reflecting mirror comprised of at least a horizontal-reference-curve reflecting area, a slant-reference-curve reflecting area and a second-slant-reference-curve reflecting area;

wherein said horizontal-reference-curve reflecting area is defined by a reference curve formed in a horizontal reference plane that includes said optical axis, said reference curve defining a paraboloid of revolution having an axis parallel with a light beam vector of reflected light when light assumed to be emitted from a reference point of the reference curve positioned on the optical axis is reflected at an arbitrary point on the reference curve, wherein the paraboloid passes through the reflection point, and has the reference point as a focus on a virtual plane containing the light beam vector, and said paraboloid of revolution is intersected by planes perpendicular to the horizontal plane;

wherein said slant-reference-curve reflecting area is defined by a reference curve formed in a slanted reference plane rotated about the optical axis, said slanted reference plane formed at a predetermined angle from the horizontal reference plane, said reference curve defining a virtual paraboloid of revolution having an axis parallel with a light beam vector of reflected light when light assumed to be emitted from a reference point of the reference curve positioned on the optical axis is reflected at an arbitrary point on the reference curve, wherein the paraboloid passes through the reflection point, and has the reference point as a focus on a virtual plane containing the light beam vector, and said paraboloid of revolution is intersected by planes perpendicular to the slanted plane; and wherein said second-slant-reference-curve reflecting area is defined by a reference curve formed in a second slanted reference plane rotated about the optical axis, said second slanted reference plane formed at a second predetermined angle from the horizontal reference plane, said reference curve defining a virtual paraboloid of revolution having an axis parallel with a light beam vector of reflected light when light assumed to be emitted from a reference point of the reference curve positioned on the optical axis is reflected at an arbitrary point on the reference curve, wherein the paraboloid passes through the reflection point, and has the reference point as a focus on a virtual plane containing the light beam vector, and said paraboloid of revolution is intersected by planes perpendicular to the second slanted reference plane wherein said light source body is disposed near the reference points for the reference curves.

11. The vehicle head lamp claimed in claim 10, wherein said predetermined angle is equal to an angle of a slant cutoff line with a horizontal line.

12. The vehicle head lamp claimed in claim 10, wherein said second predetermined angle is larger than 0° and smaller than the angle of a slant cutoff line with the horizontal line.

* * * * *